US005817448A

United States Patent [19]

Hayashi et al.

[11] Patent Number: 5,817,448

[45] Date of Patent: Oct. 6, 1998

[54] SILVER HALIDE PHOTOGRAPHIC MATERIAL AND METHOD FOR PROCESSING THE SAME

[75] Inventors: Hiroshi Hayashi; Yuji Shirakura, both of Kanagawa, Japan

[73] Assignee: Fuji Photo Film Co., Ltd., Kanagawa, Japan

[21] Appl. No.: 788,026

[22] Filed: Jan. 24, 1997

[30] Foreign Application Priority Data

Jan. 25, 1996 [JP] Japan ..... 8-030170

[51] Int. Cl.[6] ..... G03C 1/79; G03C 1/815

[52] U.S. Cl. ..... 430/399; 430/536; 430/538; 430/933; 430/963

[58] Field of Search ..... 430/538, 933, 430/963, 536, 399

[56] References Cited

U.S. PATENT DOCUMENTS

| | | | |
|---|---|---|---|
| 3,449,257 | 6/1969 | Tuite et al. | 430/933 |
| 3,501,298 | 3/1970 | Crawford | 430/933 |
| 4,592,991 | 6/1986 | Yoshida et al. | 430/933 |
| 4,794,071 | 12/1988 | Tomko et al. | 430/538 |
| 5,061,610 | 10/1991 | Carroll et al. | 430/538 |
| 5,116,721 | 5/1992 | Yamamoto | 430/963 |
| 5,126,237 | 6/1992 | Okumura et al. | 430/933 |
| 5,198,328 | 3/1993 | Shiba et al. | 430/963 |
| 5,198,330 | 3/1993 | Martic et al. | 430/538 |
| 5,264,330 | 11/1993 | Yoshida et al. | 430/963 |
| 5,569,577 | 10/1996 | Hasebe | 430/538 |

FOREIGN PATENT DOCUMENTS

| | | |
|---|---|---|
| A-0684278 | 11/1995 | European Pat. Off. . |
| A-2-188573 | 7/1990 | Japan . |

*Primary Examiner*—Richard L. Schilling
*Attorney, Agent, or Firm*—Sughrue, Mion, Zinn, Macpeak & Seas, PLLC

[57] ABSTRACT

A silver halide photographic material comprising a support having provided thereon at least one light-sensitive silver halide emulsion layer, wherein a silver halide emulsion in said at least one light-sensitive silver halide emulsion layer is a high silver chloride emulsion having a silver chloride content of 95 mol % or more, said support comprises a resin coated paper, and a resin layer of the side on which the light-sensitive silver halide emulsion layer is provided of said resin coated paper comprises at least a titanium dioxide pigment and at least one brightening agent(s) selected from the group consisting of a bis(benzoxazolyl)naphthalene based brightening agent, a bis(benzoxazolyl)thiophene based brightening agent, a coumarin based brightening agent and a pyrazoline based brightening agent.

19 Claims, No Drawings

SILVER HALIDE PHOTOGRAPHIC MATERIAL AND METHOD FOR PROCESSING THE SAME

FIELD OF THE INVENTION

The present invention relates to a silver halide photographic material and a method for processing the same and, specifically, to a silver halide color photographic material with which the photographic image having an improved whiteness degree can be formed, less fog occurs even when subjected to super rapid processing with a reduced replenishing rate, and the photographic image having sufficient image density can be formed, and a method for processing the same.

BACKGROUND OF THE INVENTION

Various approaches to the improvement of a whiteness degree of a silver halide photographic material have been practiced, in general. In a silver halide photographic material (hereinafter also referred to as "a photographic material"), it has been known for a long time to use various heterocyclic compounds, mercapto compounds and metal salts such as 4-hydroxy-6-methyl-1,3,3a,7-tetraazaindene, 3-methylbenzothiazole, 1-phenyl-5-mercaptotetrazole and the like to inhibit fog which is the cause of the stain of a white background. The compounds which can be used for such a purpose are described in literature cited in T. H. James, *The Theory of the Photographic Process,* the 4th Ed., Macmillan (1977). Methods for improving a white background are also known such as a technique of accelerating dissolving out of a dye from a photographic material and a technique of accelerating desorption of a sensitizing dye from an emulsion. For example, techniques of improving the acceleration of the removal of sensitizing dyes from photographic materials using water-soluble stilbene based brightening agents or nonionic surfactants are disclosed in *Research Disclosure,* 20733 (June, 1961). With respect to the rapid removal of dyes and the like, a technique of using a bis-guanidine compound is disclosed in JP-A-5-303185 (the term "JP-A" as used herein means an "unexamined published Japanese patent application").

On the other hand, the investigations concerning photographic supports for the improvement of a white background have been conducted, for example, the kinds of the crystals of the titanium dioxide added to a resin layer, the methods of addition thereof and surface processing methods are disclosed in U.S. Pat. No. 3,501,298, JP-A-52-35625 and JP-A-57-108849.

Titanium dioxide has functions of heightening not only a water resistance but also a light reflection efficiency. Therefore, it is effective to increase the density of titanium dioxide for the purpose of improving the sharpness of an image. However, this method has such subsidiary ill effects as a crack in a resin layer is generated (hereinafter referred to as "a film crack"), or a streak is generated at the die lip part of an extruder when a resin layer is extrusion molded (hereinafter referred to as "a die lip streak"). A technique of lowering the melting point of a resin and adding a tackifying agent to the resin for improving such drawbacks is disclosed in WO 92/17538, but the adhesion of the resin layer to a paper substrate (a raw paper) is not sufficient, therefore, this technique is not satisfactory.

Further, the incorporation of a brightening agent into a photographic material has also been discussed, and the inclusion of a brightening agent into a support is disclosed in U.S. Pat. Nos. 3,501,298, 3,449,257, 4,794,071, JP-A-2-168249, JP-A-2-71256 and JP-A-3-91740. Each of these brightening agents disclosed in the above patents can certainly improve a whiteness degree but various problems still remain such that a brightening agent moves to the interface and deteriorates the adhesion of a brightening agent-containing layer to an emulsion surface and a paper substrate (a raw paper) when a support is preserved in a roll state, a white background is, on the contrary, colored yellow when development processed and, further, since the addition amount of a brightening agent is extremely small, stable preparation of a support is hindered in the point of weighing accuracy and the like.

Further, in recent years, shortening of processing time of development processing of a photographic material (rapidity) has progressed. In particular, a compact type automatic processor which is called mini lab is installed in stores and rapid processing services are prevailing to customers. In the above processing step, the reduction of replenishing rate of processing solutions is conducted positively in view of saving resources and the environmental protection. Such rapidity of processing needs the activation of processing steps (the increases of the kinds of additives and concentrations) and causes the deterioration of the water quality of washing water due to the reduction of replenisher (the increases of the concentrations of the dyes and sensitizing dyes dissolved out) and, therefore, conditions for maintaining purer whiteness degree have become severer.

Further, in the techniques of the above patents in which a brightening agent is added to a support, when a processing time is shortened or processing is conducted with reduced amounts of replenishers, the residual amount of ultraviolet absorbing components generated by the decompositions of dyes, sensitizing dyes, antioxidants and the like increases, and as these increased residual ultraviolet absorbing components absorb ultraviolet ray, the effects of improving the whiteness degree of the above patents are not yet sufficient, or a problem still remains in the stability at the time of preparation (a uniform white background can be secured constantly).

SUMMARY OF THE INVENTION

Accordingly, an object of the present invention is to provide a silver halide photographic material which is improved in whiteness degree and a method for processing the same and, more specifically, to provide a silver halide photographic material whose whiteness degree is improved even when processed in development processing with a reduced replenishing rate and/or with shortened processing time, and a method for processing the same.

As a result of eager investigation, the present inventors have found that unexpected effect can be obtained in rapid processing with a reduced replenishing rate by including a specific brightening agent in a support and designing an effective photographic material for improving a whiteness degree. The present invention has been attained as a result of further investigation based on the above findings.

The above object of the present invention has been achieved by the following means.

(1) A silver halide photographic material comprising a support having provided thereon at least one light-sensitive silver halide emulsion layer, wherein a silver halide emulsion in said at least one light-sensitive silver halide emulsion layer is a high silver chloride emulsion having a silver chloride content of 95 mol % or more, said support comprises a resin coated paper, and a resin layer of the side on which the light-sensitive silver halide emulsion layer is provided of said resin coated paper comprises at least a titanium dioxide pigment and at least one brightening agent (s) selected from the group consisting of a bis(benzoxazolyl) naphthalene based brightening agent, a bis(benzoxazolyl) thiophene based brightening agent, a coumarin based brightening agent and a pyrazoline based brightening agent.

(2) A silver halide photographic material comprising a support having provided thereon three light-sensitive silver halide emulsion layers having different light-sensitive wavelength regions, wherein silver halide emulsions in said three light-sensitive silver halide emulsion layers are high silver chloride emulsions having a silver chloride content of 95 mol % or more and the total coating amount of silver is 0.65 g per $m^2$ or less, said support comprises a resin coated paper, and a resin layer of the side on which the light-sensitive silver halide emulsion layers are provided of said resin coated paper comprises at least a titanium dioxide pigment and at least one bis(benzoxazolyl)stilbene based brightening agent(s).

(3) The silver halide photographic material as described in (1) or (2), wherein the surface of the grain of the titanium dioxide in said resin layer is coated with a silane coupling agent.

(4) The silver halide photographic material as described in any one of (1) to (3), wherein said resin layer comprises at least two layers.

(5) The silver halide photographic material as described in any one of (1) to (4), wherein the refractive indices of at least two layers of hydrophilic colloid layers constituting said silver halide photographic material are from 1.50 to 1.56.

(6) The silver halide photographic material as described in any one of (1) to (5), wherein the reflection density of said silver halide photographic material at 400 nm is 0.22 or more.

(7) The silver halide photographic material as described in any one of (1), (3) to (6), wherein said silver halide photographic material comprises three light-sensitive silver halide emulsion layers having different light-sensitive wavelength regions and the total coating amount of silver is 0.65 g per $m^2$ or less.

(8) A method for processing a silver halide photographic material as described in any one of (1) to (7), wherein processing is conducted with a replenishing rate of a developing solution of 60 ml or less per $m^2$ of the photographic material.

(9) A method for processing a silver halide photographic material as described in any one of (1) to (7), wherein the time of development process is 45 seconds or less.

(10) A method for processing a silver halide photographic material as described in any one of (1) to (7), wherein the time of development process is 30 seconds or less and time from the start of development until the termination of drying is 120 seconds or less.

DETAILED DESCRIPTION OF THE INVENTION

The embodiments of the present invention will be described in detail below.

A resin layer of a support for use in the present invention can be formed, in general, using polyolefins which are conventionally used. Polyethylene is particularly preferred of polyolefins.

Polyesters are useful as well. Polyester of 2,6-naphthalenedicarboxylic acid (NDCA) and ethylene glycol (EG), polyester of NDCA, terephthalic acid and EG, and polyethylene terephthalate are preferred as polyesters.

Brightening agents for use in the present invention can be mixed in polyolefin as fine grains, and as they are heated at 300° C. or so when added in a melted polyolefin and formed the mixture into a film, they must have the heat resistance capable of undergoing such a temperature (i.e., do not decompose or do not color).

Further, when a laminated paper is preserved in a roll state, as brightening agents for use in the present invention hardly move in a polyolefin film and deposit at the surface, a problem of "repellency (comets)" does not arise when an emulsion is coated on this support. These compounds are put on the market and commercial products can be used. Specifically, they can be selected from among the groups of "Whitefluor" goods produced by Sumitomo Chemical Co., Ltd., "Hakkol" goods produced by Showa Chemicals Co., Ltd., "Hostalux" goods produced by Hoechst Limited, and "Kayalight" goods produced by Nippon Kayaku Co., Ltd.

Further, brightening agents for use in the present invention can be synthesized according to the methods disclosed in JP-A-2-188573 and EP-A-684278.

Preferred chemical structures of the brightening agents for use in the present invention and specific examples thereof are described in detail below.

A bis(benzoxazolyl)stilbene based brightening agent is preferably represented by formula (I):

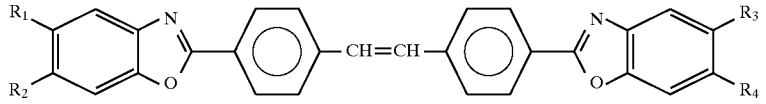

(I)

wherein $R_1$, $R_2$, $R_3$ and $R_4$, which may be the same or different, each represents a hydrogen atom, an organic group such as an alkyl group having from 1 to 15 carbon atoms, an alkoxyl group having from 1 to 15 carbon atoms, or an aryl group having from 6 to 15 carbon atoms, each of which may be substituted, more preferably a hydrogen atom, a methyl group, an ethyl group, a tert-butyl group or a tert-octyl group.

A bis(benzoxazolyl)naphthalene based brightening agent is preferably represented by formula (II):

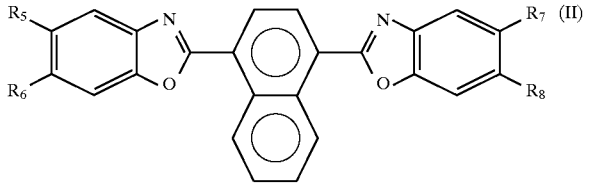

(II)

wherein $R_5$, $R_6$, $R_7$ and $R_8$, which may be the same or different, each represents a hydrogen atom, an organic group such as an alkyl group having from 1 to 15 carbon atoms, an alkoxyl group having from 1 to 15 carbon atoms, or an aryl group having from 6 to 15 carbon atoms, each of which may be substituted, more preferably a hydrogen atom, a methyl group, an ethyl group, a tert-butyl group or a tert-octyl group.

A bis(benzoxazolyl)thiophene based brightening agent is preferably represented by formula (III):

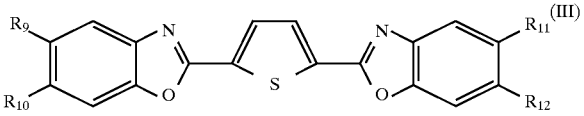

(III)

wherein $R_9$, $R_{10}$, $R_{11}$, and $R_{12}$, which may be the same or different, each represents a hydrogen atom, an organic group such as an alkyl group having from 1 to 15 carbon atoms, an alkoxyl group having from 1 to 15 carbon atoms, or an aryl group having from 6 to 15 carbon atoms, each of which may be an ethyl group, a tert-butyl group or a tert-octyl group.

A pyrazoline based brightening agent includes pyrazoline derivatives and pyrazolone derivatives and is preferably represented by formula (IV):

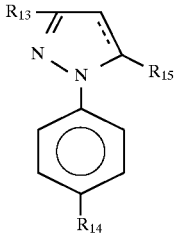

(IV)

wherein $R_{13}$, $R_{14}$ and $R_{15}$, which may be the same or different, each represents a hydrogen atom, an organic group such as an alkyl group having from 1 to 15 carbon atoms, an alkoxyl group having from 1 to 15 carbon atoms, an aryl group having from 6 to 15 carbon atoms, or a sulfonamido group, each of which may be substituted, more preferably a hydrogen atom, a methyl group, an ethyl group, a tert-butyl group, a phenyl group or a tert-octyl group.

A coumarin based brightening agent is preferably represented by formula (V):

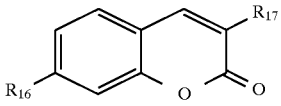

(V)

wherein $R_{16}$ preferably represents an organic group containing a triazine or triazole ring; and $R_{17}$ preferably represents an organic group such as an alkyl group, an alkoxyl group or an aryl group.

Specific examples of preferred brightening agents are shown below but the present invention is not limited thereto.

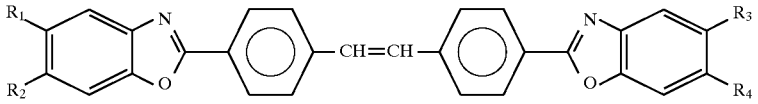

| | $R_1$ | $R_2$ | $R_3$ | $R_4$ |
|---|---|---|---|---|
| I-(1) | H | H | H | H |
| I-(2) | H | $CH_3$ | H | H |
| I-(3) | H | $CH_3$ | H | $CH_3$ |
| I-(4) | H | $C_2H_5$ | H | H |
| I-(5) | H | $C_2H_5$ | H | $C_2H_5$ |
| I-(6) | H | t-$C_4H_9$ | H | H |
| I-(7) | H | t-$C_4H_9$ | H | t-$C_4H_9$ |
| I-(8) | H | t-$C_8H_{17}$ | H | H |
| I-(9) | H | t-$C_8H_{17}$ | H | t-$C_8H_{17}$ |
| I-(10) | H | $OCH_3$ | H | $OCH_3$ |
| I-(11) | H | $OC_2H_5$ | H | H |
| I-(12) | H | 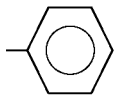 | H | 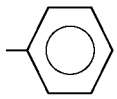 |
| I-(13) | $CH_3$ | $CH_3$ | $CH_3$ | $CH_3$ |
| I-(14) | $C_2H_5$ | $C_2H_5$ | $C_2H_5$ | $C_2H_5$ |

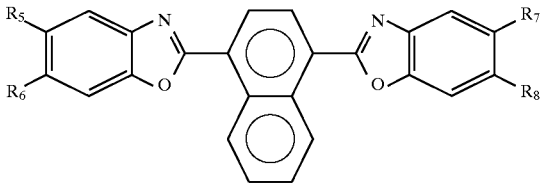

| | $R_5$ | $R_6$ | $R_7$ | $R_8$ |
|---|---|---|---|---|
| II-(1) | H | H | H | H |
| II-(2) | H | t-$C_4H_9$ | H | H |
| II-(3) | H | $CH_3$ | H | $CH_3$ |
| II-(4) | H | $OCH_3$ | H | $OCH_3$ |
| II-(5) | H | $C_2H_5$ | H | H |
| II-(6) | H | t-$C_8H_{17}$ | H | H |
| II-(7) | H | t-$C_8H_{17}$ | H | t-$C_8H_{17}$ |

-continued
| | | | | |
|---|---|---|---|---|
| II-(8) | H | t-$C_{12}H_{25}$ | H | i-$C_{12}H_{25}$ |
| II-(9) | $CH_3$ | $CH_3$ | $CH_3$ | $CH_3$ |
| II-(10) | H | $OCH_3$ | H | $OCH_3$ |
| II-(11) | H | 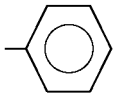 | H | 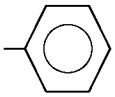 |
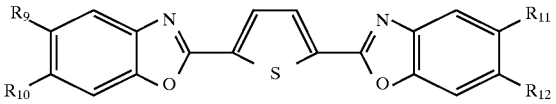
| | $R_9$ | $R_{10}$ | $R_{11}$ | $R_{12}$ |
|---|---|---|---|---|
| III-(1) | H | H | H | H |
| III-(2) | H | $CH_3$ | H | $CH_3$ |
| III-(3) | H | $OCH_3$ | H | $OCH_3$ |
| III-(4) | H | $C_2H_5$ | H | $C_2H_5$ |
| III-(5) | $CH_3$ | $CH_3$ | $CH_3$ | $CH_3$ |
| III-(6) | H | t-$C_4H_9$ | H | t-$C_4H_9$ |
| III-(7) | H | 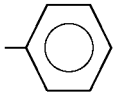 | H | 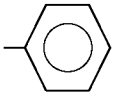 |
| III-(8) | H | t-$C_8H_{17}$ | H | t-$C_8H_{17}$ |
| III-(9) | H | i-$C_{12}H_{25}$ | H | i-$C_{12}H_{25}$ |
IV-(1)
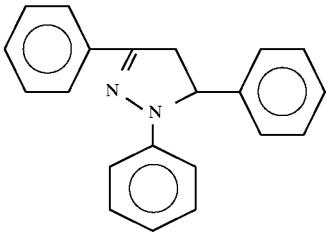
IV-(2)
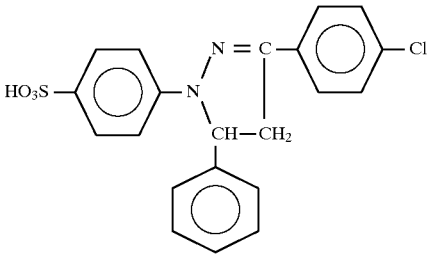
IV-(3)
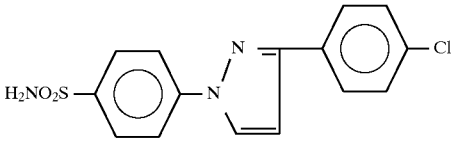
IV-(4)
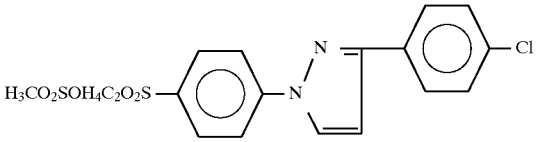

-continued
IV-(5)
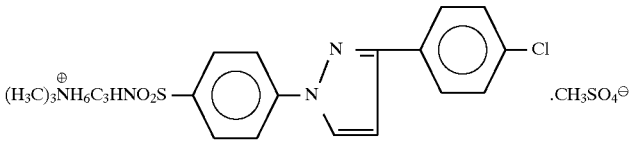
IV-(6)
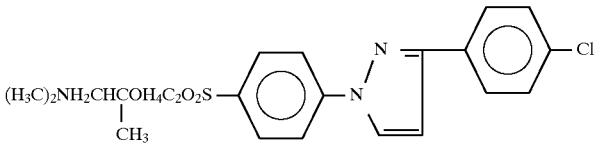
IV-(7)
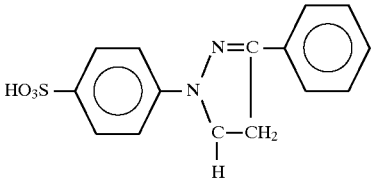
IV-(8)
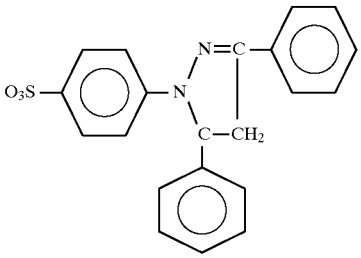
V-(1)
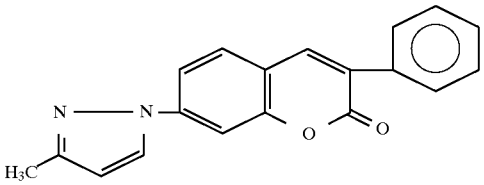
C.I. Fluorescent Brightener 156
V-(2)
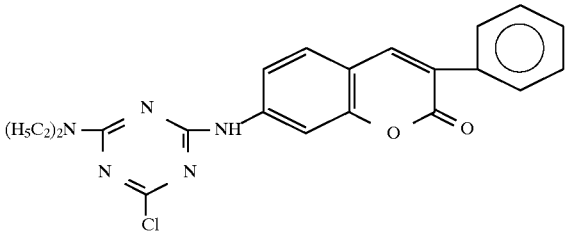

-continued

V-(3)

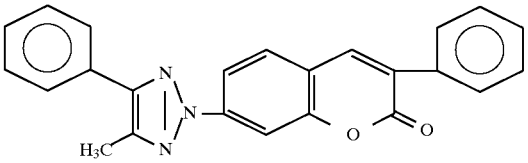

V-(4)

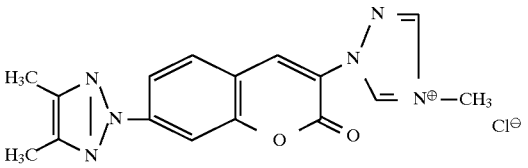

V-(5)

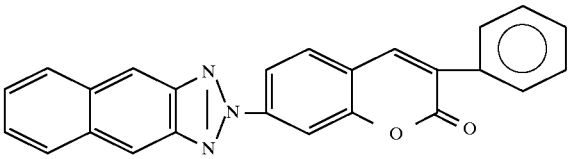

The proportion (weight ratio) of the brightening agent to the resin is generally 0.01 to 0.4% and preferably 0.03 to 0.3%.

A titanium dioxide which can be added to a resin layer with a brightening agent of the present invention is described below. A titanium dioxide pigment which can be used in the present invention may be a rutile type or an anatase type, which can be selected arbitrarily according to the objective tint and sharpness, or they can be used in admixture for improving both masking property and whiteness degree. Further, a titanium dioxide pigment which can be used in the present invention may be surface-treated with an inorganic or organic compound for improving dispersibility. For example, those disclosed in JP-A-52-35625, JP-A-55-10865, JP-A-57-35855, JP-A-62-25753 and JP-A-62-103635 as specific examples of surface treatment can be used in the present invention. Inorganic compounds such as aluminum oxide hydrate, zinc oxide hydrate and silicon dioxide, and organic compounds such as dihydric alcohol, trihydric alcohol, tetrahydric alcohol, trimethylolamine, a titanate coupling agent and a silane coupling agent are preferably used in the surface treatment. The amount of each surface treating agent can be determined according to each purpose but, in the case of an inorganic surface treating agent, the amount of about 3 wt % or less is generally used, preferably from 0.01 to 1 wt %, based on the titanium dioxide, and in the case of organic surface treating agent, the amount of about 5 wt % or less is generally used, preferably from 0.1 to 3 wt %, based on the titanium dioxide.

Grains of titanium dioxide pigment are preferably contained in the resin in the density of from 8 to 50 wt % or more, more preferably from 14 to 45 wt %, and still more preferably from 20 to 40 wt %. A light reflecting material such as zinc oxide, calcium carbonate or calcium sulfate may be contained in the resin layer in a dispersed state other than titanium dioxide. The concentration of the white pigment of the water resistant resin containing titanium dioxide white pigment is not necessarily uniform. It is advantageous from the economical viewpoint to reduce the amount used of the white pigment by providing two or three water resistant resin layers having different concentrations of the white pigment on one side and making the concentration of the white pigment in the water resistant resin layer on which the emulsion layer is provided high. Alternatively, it is preferred from the producing suitability to provide three or more water resistant resin layers on one side with making the concentration of the white pigment in the intermediate water resistant resin layer high and making the concentration of the white pigment in the water resistant resin layer nearest to the emulsion layer and the thickness thereof low and thin, respectively.

The fine grains of the white pigment are preferred to be dispersed uniformly in the reflective layer not to be agglomerated. The size of the distribution can be obtained by measuring the proportion of the area occupied by the fine grains projected in each unit area (%) (Ri). The variation coefficient of the proportions of the occupied areas (%) can be determined as a ratio of the standard deviation (s) of Ri to the mean value of Ri (R), that is, s/R. In the present invention, the variation coefficient of the proportions of the occupied areas (%) of the fine grains of the pigment is preferably 0.15 or less, more preferably 0.12 or less, and particularly preferably 0.08 or less.

The silane coupling agent for use in the present invention is preferably a silane coupling agent having a siloxane bond and an ethoxy-modified or methoxy-modified terminal, and a silicon oligomer is particularly preferred (having from 1 to 5 repeating units of a siloxane bond). A repeating unit of a siloxane bond is the structure represented by —Si(R)(OR)—O— (wherein R represents a methyl group or an ethyl group).

When the silane coupling agent having the above structure is contained in thermoplastic resin components and titanium dioxide in an amount of from 0.01 to 5 wt % based on the titanium dioxide and, in particular, the titanium oxide treated with the above-described aluminum oxide hydrate is used, deterioration of film conditions or degradation of the film due to foaming can be prevented, which is generated when titanium dioxide is contained in thermoplastic resin components at high concentration, and excellent processing property of lamination by melt extrusion can be obtained. When the content of the silicon oligomer is less than 0.01 wt % based on the titanium dioxide, coagulated particles are generated in the resin film at the time of the dispersion of titanium dioxide in the resin and a uniform resin layer cannot be formed. On the contrary, when the content of the silicon oligomer is more than 0.5 wt % based on the titanium dioxide, the cost becomes high for the effect.

A method of previously mixing a silicon oligomer with titanium dioxide and other additives using a high speed mixer is generally used as a method of surface-treating titanium dioxide with a silicon oligomer, but the method of previously incorporating a silicon oligomer into a thermoplastic resin may also be used.

Titanium dioxide is incorporated into a water resistant resin with a kneader such as a twin roll, a triplet roll, a kneader or a Banbury mixer using a metal salt of higher fatty acid, higher fatty acid ester, higher fatty acid amide, higher fatty acid, polyolefin wax and the like as a dispersing aid. The obtained water resistant resin containing a titanium dioxide pigment is formed into pellets and the pellets are used as a master batch of a titanium dioxide pigment. Stearic acid metal salt is preferably used as a dispersing aid, with more preferred being zinc stearate.

The concentration of the titanium dioxide in pellets is preferably from 30 to 75 wt % or so, and the concentration of the dispersing aid is, in general, preferably from 0.5 to 10 wt %. If the concentration of the titanium dioxide is less than 30 wt %, the bulk of a pellet becomes big, on the contrary, if it is greater than 75 wt %, the dispersibility of the titanium dioxide is deteriorated and, as a result, pellets are liable to be cracked. Further, it is preferred for the master batch containing titanium dioxide be dried or vacuum dried at 50° to 90° C. for 2 hours or more before use.

A water resistant resin layer of the side on which an emulsion layer is coated can contain a bluing agent. Examples of bluing agents include generally known ultramarine blue, cobalt blue, phosphate oxide cobalt, a quinacridone based pigment and mixtures thereof. The diameter of a grain of a bluing agent is not particularly limited but in general from 0.3 to 10 $\mu$m is preferred.

When a bluing agent is used in the uppermost layer of multilayer water resistant resin layers according to the present invention, the amount is from 0.1 to 0.5 wt %, more preferably from 0.2 to 0.4 wt %, and when used in the lower layer, from 0.01 to 0.30 wt %, more preferably from 0.015 to 0.15 wt %.

A bluing agent is incorporated into a water resistant resin with a kneader such as a twin roll, a triplet roll, a kneader or a Banbury mixer. The obtained water resistant resin containing a bluing agent is formed into pellets and the pellets are used as a master batch of a bluing agent.

The concentration of the bluing agent in pellets is preferably from 1 to 30 wt % or so. Titanium dioxide can be incorporated together when forming pellets containing a bluing agent. For assisting dispersion of a bluing agent, a low molecular weight water resistant resin, polyolefin wax, a metal salt of higher fatty acid, higher fatty acid ester, higher fatty acid amide, or higher fatty acid can be used as a dispersing aid.

An antioxidant can be contained in a water resistant resin layer, and the content is preferably from 50 to 1,000 ppm or so based on the amount of the water resistant resin. The thus-prepared master batch containing a titanium dioxide pigment and/or a bluing agent is diluted arbitrarily with a water resistant resin and used for extrusion lamination.

A tackifying resin optionally selected from a rosin derivative resin, a terpene resin (e.g., high molecular β-pinene), a coumarone-indene resin, a petroleum based hydrocarbon resin, etc., can be used for improving adhesion between a paper substrate and a water resistant resin. They may be used alone or two or more thereof can be used in admixture.

Specific examples of the above-described petroleum based hydrocarbon resins include an aliphatic-based petroleum resin, an aromatic-based petroleum resin, a dicyclopentadiene based petroleum resin, a copolymer based petroleum resin, a hydrogenated petroleum resin, and an alicyclic-based petroleum resin. An aliphatic-based petroleum resin particularly preferably has 5 carbon atoms and an aromatic-based petroleum resin particularly preferably has 9 carbon atoms.

The compounding amount of the tackifying resin is from 0.5 to 60 wt %, preferably from 10 to 35 wt %, based on the above water resistant resin. When the compounding amount of the tackifying resin is less than 0.5 wt %, adhesion failure occurs, while when it exceeds 60 wt %, the thickness in the direction perpendicular to the coating direction becomes uneven during production and the edges of the support become thick and the production effect is disadvantageously affected.

Examples of adhesive resins capable of thermal adhesion with the above water resistant resin include an ionomer, an ethylene-vinyl acetate copolymer (EVA), an ethylene-acrylic acid copolymer and metal salts of these compounds. The compounding amount of the adhesive resin is from 20 to 500 wt %, preferably from 50 to 200 wt %, based on the above water resistant resin. The tackifying resin and the adhesive resin may be used in combination.

A single layer or multilayer water resistant resin layer(s) according to the present invention is(are) formed by melting pellets containing the above-described titanium dioxide pigment and/or a bluing agent, diluting the molten product with a water resistant resin and melting, if necessary, and laminating it by either an ordinary laminating method or a successive laminating method, or a laminating method with a single layer or multilayer extrusion die such as a feed block type, a multimanifold type or a multislot type on a paper or synthetic paper substrate which is traveling. The shape of a single layer or multilayer extrusion die is not particularly limited but, in general, a T-type die and a coat hanger die are preferably used.

Before a resin is coated on a paper substrate, a paper substrate is preferably subjected to an activation treatment such as a corona discharge treatment, a flame treatment, a glow discharge treatment, or a plasma treatment.

A water resistant resin layer according to the present invention may comprise a single layer or multilayers as described above. For example, when a water resistant resin layer comprises three layers, the film thickness of the uppermost layer is preferably from 0.5 to 50 $\mu$m, that of the interlayer is preferably from 5 to 50 $\mu$m, and the lowermost layer is preferably from 0.5 to 50 $\mu$m.

The outermost layer of the water resistant resin layers on the emulsion layer coating side may have glossy surface or the surface may be embossed with the fine surface disclosed in JP-A-55-26507, a matting surface or a silk surface. The surface of the resin layer coated on the back side of the paper substrate may be embossed with a dull surface. The surface after being embossed can be subjected to an activation treatment such as a corona discharge treatment or a flame treatment. Further, after the activation treatment, the surface may be subjected to the underlayer treatment as disclosed in JP-A-61-846443.

The paper substrate for use in the present invention may be any of natural pulp paper comprising ordinary natural pulp as a main component, mixed paper comprising natural pulp and synthetic fiber, synthetic fiber paper comprising synthetic fiber as a main component, so-called synthetic paper which is pseudo-paper of synthetic resin film such as polystyrene, polyethylene terephthalate, polypropylene, etc., but natural pulp paper (hereinafter referred to as merely "raw paper") is particularly preferably used as a substrate for photographic paper. Raw paper may be either of neutral paper (pH: 5 to 9) or acidic paper but neutral paper is preferred.

As additives for raw paper, in addition to an alkyl ketene dimer, a filler such as clay, talc, calcium carbonate, and urea resin fine grains, a sizing agent such as rosin, a higher fatty acid salt, paraffin wax, and alkenyl succinic acid, a paper strength intensifying agent such as polyacrylamide, and a fixing agent such as aluminum sulfate are used. Further, a dye, a pigment, a slime controlling agent and a defoaming agent are added, if required.

Moreover, the following softening agents can be used, if desired.

With respect to softening agents, there is a description, for example, in *Kami Kako Benran* (*Paper Processing Handbook*), edited by Shiyaku Time Co., pages 554 and 555 (1980), and those having a molecular weight of 200 or more are particularly preferred. These softening agents have a hydrophobic group having 10 or more carbon atoms and are an amine salt or a quaternary ammonium salt which is self-fixable with cellulose.

Specific examples of softening agents include a reaction product of maleic anhydride copolymer with polyalkylenepolyamine, a reaction product of higher fatty acid with polyalkylenepolyamine, a reaction product of urethane alcohol with an alkylating agent, and a quaternary ammonium salt of higher fatty acid, and a reaction product of maleic anhydride copolymer with polyalkylenepolyamine and a reaction product of urethane alcohol with an alkylating agent are particularly preferred.

The surface of pulp can be sizing treated with a film forming polymer such as gelatin, starch, carboxymethyl cellulose, polyacrylamide, polyvinyl alcohol, and a modified product of polyvinyl alcohol. Modified product of polyvinyl alcohol in this case are a carboxyl group modified product, a silanol modified product and a copolymer with acrylamide. The coating amount of a film forming polymer is generally from 0.1 to 5.0 g/m$^2$, preferably from 0.5 to 2.0 g/m$^2$.

Further, the above film forming polymer can contain an antistatic agent, a brightening agent, a pigment and a defoaming agent, if required.

The production of raw paper is carried out by making paper using the above pulp and pulp slurry, which contains a filler, a sizing agent, a paper strength intensifying agent and a fixing agent according to necessity in addition to the pulp, with a paper machine such as Fourdrinier, drying and winding up. The above-described surface sizing treatment is conducted at any time before or after drying, and a calendering treatment is conducted during the time after drying and before winding up.

When the surface sizing treatment is conducted after drying, the above-described calendering treatment can be conducted at any time before and after the sizing treatment but it is preferred to conduct the calendering treatment in the final finishing process after various treatments were carried out. Known metal rolls or elastic rolls used in usual paper making are used in the calendering treatment.

The raw paper for use in a support for a photographic paper according to the present invention is finally adjusted to a film thickness of from 50 to 250 $\mu$m. The density of the raw paper is generally from 0.8 to 1.3 g/m$^2$, preferably from 1.0 to 1.2 g/m$^2$.

A support for a photographic paper of the present invention can be provided with various back coat layers for antistatic and anticurling purposes. Moreover, inorganic antistatic agents, organic antistatic agents, hydrophilic binders, latexes, hardening agents, pigments and surfactants disclosed or exemplified in JP-B-52-18020 (the term "JP-B" as used herein means an "examined Japanese patent publication"), JP-B-57-9059, JP-B-57-53940, JP-B-58-56859, JP-A-59-214849, and JP-A-58-184144 can be contained in back coat layers in arbitrary combinations.

Photographic materials which can be used in the present invention are described below.

The present invention intends to effectively utilize the brightening agent contained in a support, and the degree of the effect is influenced by the absorption amount of the ultraviolet light absorbed by the brightening agent. The barometer of this factor is represented by the reflection density at 400 nm of the photographic material in the present invention. If the reflection density is too low, the effect in the constitution of the present invention is not so conspicuous, while when it is too high, the intensity of the brightening action according to the present invention becomes weak. Preferred reflection density at 400 nm by a reflective type spectrophotometer (for example, the measurement is conducted using 3410 type spectrophotometer manufactured by Hitachi, Ltd. connected with a 120 mm integrating sphere) is generally from 0.22 to 1.0, preferably from 0.22 to 0.40, and more preferably from 0.25 to 0.35.

The refractive indices of hydrophilic colloid layers are described below, which bring out the effect of the present invention the same as the above viewpoint. In a preferred embodiment of the present invention, the layers of the silver halide photographic material including the light-sensitive and light-insensitive layers are formed using hydrophilic colloid, specifically gelatin, as a binder. Each layer contains compounds important for forming images such as silver halide emulsions, emulsified couplers and emulsified color mixing preventives. Further, high boiling point solvents for solving these compounds are contained, and the refractive index of the entire layers is changed because of these compounds. The layer per se preferably has the same refractive index as that of the gelatin binder, specifically at least two layers of the plurality of layers comprising the photographic material have refractive indices of from 1.50 to 1.56, more preferably from 1.51 to 1.55.

The coating amount of the silver of a silver halide photographic material which can be used in the present invention is described below.

The less the residual amount of silver, the more white is the whiteness degree of the completed images, and the more improved is the brightening effect. In recent years, conditions of desilvering process have become severer as rapid processing progresses and replenishing rate decreases. Reducing the coating amount of silver is one useful means to conduct desilvering rapidly and reduce the residual amount of silver. However, it is a matter of course that photographic properties are disadvantageously affected with the reduction of the coating amount of silver. For securing a white background of high grade, in particular, for securing a white background of high grade when rapid and low replenishing rate processing is conducted, the coating amount of silver is preferably from 0.3 g to 0.65 g, more preferably from 0.4 g to 0.6 g, per square meter of the photographic material.

The color photographic material of the present invention preferably comprises a reflective support having coated thereon at least one yellow color-forming silver halide emulsion layer, at least one magenta color-forming silver halide emulsion layer, and at least one cyan color-forming silver halide emulsion layer. In a color photographic paper for general use, color reproduction can be effected according to the subtractive color process by incorporating into silver halide emulsion layers color couplers capable of forming dyes having a complementary color relationship to light to which the corresponding silver halide emulsion is sensitized. In a typical color photographic paper, silver halide emulsion grains are spectrally sensitized in the above described order of the color forming layers by blue-sensitive, green-sensitive, and red-sensitive spectral sensitizing dyes and coated on a support in the above described order. However, the coating can be effected by different orders. That is, there are cases when the light-sensitive layer containing the silver halide grains having the largest average grain size is preferred to be uppermost layer from the viewpoint of rapid processing or when the magenta color-forming light-sensitive layer is preferred to be undermost layer considering the storage stability under light irradiation.

Further, a constitution of a different correspondence of a light-sensitive layer to a hue of developed color from those described above may be employed, and at least one infrared-sensitive silver halide emulsion layer can be provided.

In the present invention, silver chloride, silver chlorobromide, or silver chloroiodobromide grains having a silver chloride content of 95 mol % or more is preferably used as silver halide grains. In particular, in order to expedite the development processing time, grains comprising silver chlorobromide or silver chloride substantially free of silver iodide are preferably used in the present invention. The terminology "substantially free of silver iodide" as used herein means that the silver iodide content is 1 mol % or less, preferably 0.2 mol % or less. On the other hand, for purposes of raising high illumination intensity sensitivity, enhancing spectral sensitization sensitivity, or increasing aging stability of photographic materials, high silver chloride grains containing from 0.01 to 3 mol % of silver iodide on the surface of the grain are preferably used in some cases as disclosed in JP-A-3-84545. The halide composition of the emulsion may be the same or different among grains, however, when emulsions having the same halide composition among grains are used, it is easy to homogenize the properties of grains. Also, with respect to the distribution of the halide composition inside of the silver halide emulsion grains, the grains may have a so-called uniform type structure where any portion of the silver halide grains has the same composition, the grains may have a so-called laminate type structure where the halide composition is different between the inside of the grains (core) and the shell (single layer or a plurality of layers) surrounding the core, or the grains may have such a structure that non-layered portions different in the halide composition are present inside the grains or on the surface of the grains (when present at the surface of the grains, the portions are conjugated at edges, corners or on planes), and these grains can be arbitrarily selected depending on the purposes. For attaining high sensitivity, either of the latter two cases is advantageously used rather than the grains of the uniform type structure and is also preferred in view of pressure resistivity. When the silver halide grains have either of the above described structures, the boundary between portions different in the halide compositions may be clear, or may be unclear because of mixed crystals formed due to difference in the halide composition. Further, the boundary may have sequential structural change provided positively.

The high silver chloride emulsion for use in the present invention preferably has such a structure that a silver bromide localized phase is present inside and/or on the surface of the silver halide grains in the form of a layer or a non-layer as described above. The halide composition of the above described localized phases is preferably such that the silver bromide content is at least 10 mol %, more preferably exceeding 20 mol %. The silver bromide content of the silver bromide localized phases can be analyzed according to the X-ray diffraction method (for example, *Shin-Jikken Kagaku Koza* 6, *Kozo Kaiseki* (*New Experimental Chemistry Course* 6, *Analysis of Structure*), edited by Nippon Kagaku Kai, published by Maruzen) or the like. These localized phases can be present inside the grains, at edges, corners or on planes of the grain surface. One preferred example of the localized phase is that formed by epitaxial growth at the corners of the grains.

Also, it is effective to further increase the silver chloride content of a silver halide emulsion to reduce the replenishing amount of the development processing solution. In such a case, substantially a pure silver chloride emulsion having a silver chloride content of from 98 mol % to 100 mol % is also preferably used.

The silver halide grains contained in the silver halide emulsion for use in the present invention have an average grain size (the grain size herein refers to the diameter of the circle corresponding to the projected area of the grains, and the number average is taken as the average grain size) of preferably from 0.1 $\mu$m to 2 $\mu$m.

With respect to the distribution of sizes of these grains, a so-called monodisperse emulsion having a variation coefficient (the value obtained by dividing the standard deviation of the grain size distribution by the average grain size) of 20% or less, preferably 15% or less, and more preferably 10% or less, is preferred. For obtaining a wide latitude,.it is also preferred to blend the above described monodisperse emulsions in one and the same layer or multilayer-coat the monodisperse emulsion.

The silver halide grains contained in the photographic emulsion may have a regular crystal form, such as cubic, tetradecahedral, or octahedral, an irregular crystal form, such as spherical, plate-like, or a composite form of these forms. A mixture of grains having various crystal forms may also be used. In the present invention, the grains having the above described regular crystal forms preferably occupy for 50% or more, preferably 70% or more, more preferably 90% or more.

Further, an emulsion in which the proportion of tabular grains having an average aspect ratio (circle corresponding diameter/thickness) of 5 or more, preferably 8 or more, to the entire grains exceeds 50% as a projected area can also be preferably used. Either tabular grains having {111} or {100} faces as grain surfaces are also preferably used as such tabular grains.

The silver chloride (chlorobromide) emulsion for use in the present invention can be prepared according to the methods disclosed, for example, in P. Glafkides, *Chimie et Physique Photographique,* Paul Montel (1967), G. F. Duffin, *Photographic Emulsion Chemistry,* Focal Press (1966), V. L. Zelikman, et al., *Making and Coating Photographic Emulsion*, Focal Press (1964), and so on. That is, any process, such as an acid process, a neutral process, and an ammoniacal process, can be used. A single jet method, a double jet method, and a combination of them are known as methods for reacting a soluble silver salt with a soluble halide, and any of these methods can be used. A method in which silver halide grains are formed in the atmosphere of excessive silver ions (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially an almost uniform grain size can be obtained.

It is preferred to include different kinds of metal ions or complex ions thereof to the localized phase and its substrate of the silver halide grains of the present invention. Preferred metals are selected from ions or complexes of metals belonging to Group VIII and Group IIb of the Periodic Table, a lead ion and a thallium ion.

The effect of the constitution of the photographic material of the present invention is more conspicuous when a high silver chloride content emulsion which is gold sensitized is used.

The photographic material of the present invention can preferably be used, in addition to the printing system using a general negative printer, in digital scanning exposure using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic material of the present invention can be set arbitrarily according to the wavelength of the scanning exposure light source to be used. As oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red. For making an apparatus inexpensive, high stable and compact using a semiconductor laser as a light source, it is preferred that at least two layers have spectral sensitivity maximum in the region of 670 nm or more. This is because emission wavelength region of III-V group system semiconductor laser, which is presently available, inexpensive and stable, is only in the red to infrared region. However, oscillation of II-VI group system semiconductor laser in the green and blue regions is confirmed in experimental level, and it is sufficiently expected that such a semiconductor laser shall be available inexpensively and stably according to the development of the manufacturing technology of the semiconductor laser. In such a case, the necessity that at least two layers should have spectral sensitivity maximum in the region of 670 nm or more becomes small.

In such a scanning exposure, the time of exposure of silver halide in a photographic material is the time necessary for exposure of a micro area. The minimum unit for controlling the quantity of light from each digital data is in general used as this micro area and which is called a picture element. Therefore, exposure time per picture element is varied according to the size of the picture element. The size of the picture element depends on the density of the picture element and the practical range of the density of the picture element is from 50 to 2,000 dpi. The exposure time is defined as the time necessary to expose the size of the picture element with the density of this picture element being 400 dip, and preferred exposure time is $10^{-4}$ sec or less and more preferably $10^{-6}$ sec or less.

The exposed photographic material can be processed by ordinary color development processing, but the color photographic material of the present invention is preferably subjected to bleach-fixing processing after color development for the purpose of rapid processing. In particular, as the above described high silver chloride emulsion is used in the present invention, the pH of the bleach-fixing solution is preferably about 6.5 or less and more preferably about 6 or less for the sake of acceleration of desilvering.

Preferred examples of silver halide emulsions, other substances (additives or the like) and photographic constitutional layers (arrangement of the layers or the like) applied to the light-sensitive material for use in the present invention, processing methods for processing the photographic materials and additives for the processing are disclosed in the patent publications described below, in particular, those disclosed in EP-A-355660 (corresponding to JP-A-2-139544) are preferably used.

TABLE 1

| Photographic Constitutional Element | JP-A-62-215272 | JP-A-2-33144 | EP-A-355660 |
|---|---|---|---|
| Silver Halide Emulsion | p 10, right upper column, l 6 to p. 12, left lower column, l. 5, p. 12, right lower column, 4 line up from the bottom to p. 13, left upper column, l. 17 | p. 28, right upper column, l. 16 to p. 29, right lower column, l. 11 p. 30, l l. 2 to 5 | p. 45, l 53 to p. 47, l. 3 p. 47, l l. 20 to 22 |
| Silver Halide Solvent | p. 12, left lower column, ll. 6 to 14 p. 13, left upper column, 3 line up from the bottom to p. 18, left lower column, last line | — | — |

TABLE 1-continued

| Photographic Constitutional Element | JP-A-62-215272 | JP-A-2-33144 | EP-A-355660 |
|---|---|---|---|
| Chemical Sensitizer | p. 12, left lower column, 3 line up from the bottom to right lower column, 5 line up from the bottom p. 18, right lower column, l. 1 to p. 22, right upper column, 9 line up from the bottom | p. 29, right lower column, 12 to last line | p. 47, ll. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |
| Emulsion Stabilizer | p. 39, left upper column, ll. 1 to p. 72, right upper column, last line | p. 30, left upper column, l. 14 to right upper column, l. 1 | p. 47, ll. 16 to 19 |
| Development Accelerator | p. 72, left lower column, ll. 1 to p. 91, right upper column, l. 3 | — | — |

TABLE 2

| Photographic Constitutional Element | JP-A-62-215272 | JP-A-2-33144 | EP-A-355660 |
|---|---|---|---|
| Color Coupler (cyan, magenta, and yellow which can be used in combination) | p. 91, right upper column, l. 4 to p. 121, left upper column, l. 6 | p. 3, right upper column, l. 14 to p. 18, left upper column, last line p. 30, right upper column, l. 6 to p. 35, right lower column, l. 11 | p. 4, ll. 15 to 27 p. 5, l. 30 top. 28, last line p. 45, ll. 29 to 31 p. 47, l. 23 to p. 63 l. 50 |
| Color Intensifier | p. 121, left upper column, l. 7 to p. 125, right upper column, l. 1 | — | — |
| UV Absorber | p. 125, right upper column, l. 2 to p. 127, left lower column, last line | p. 37, right lower column, l. 14 to p. 38, left upper column, l. 11 | p. 65, ll. 22 to 31 |
| Discoloration Inhibitor (image stabilizer) | p. 127, right lower column, l. 1 to p. 137, left lower column, l. 8 | p. 36, right upper column, l. 12 to p. 37, left upper column, l. 19 | p. 4, l. 30 to p. 5, l. 23 p. 29, l. 1 to p. 45, l. 25 p. 45, ll. 33 to 40 p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll 1 to 51 |
| Dispersing Method of Photographic Additives | p. 144, left lower column, l. 1 to p. 146, right upper column, l. 7 | p. 27, right lower column, l. 10 to p. 28, left upper column, last line p. 35, right lower column, l. 12 to p. 36, right upper column, l. 7 | p. 63, l. 51 to p. 64, l. 56 |

TABLE 3

| Photographic Constitutionai Element | JP-A-62-215272 | JP-A-2-33144 | EP-A-355660 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower coiumn, l. 2 | — | — |
| DIR Compound | p. 155, right lower column, ll. 3 to 9 | — | — |

TABLE 3-continued

| Photographic Constitutionai Element | JP-A-62-215272 | JP-A-2-33144 | EP-A-355660 |
|---|---|---|---|
| Layer Structure of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right column, last line | p. 38, left upper column, l. 12 to right upper column, l. 7 | p. 66, ll. 18 to 22 |
| Color Mixture Preventive | p. 185, left upper column, l. 1 to p. 188, right column, l. 3 | p. 36, right upper column, ll. 8 to 11<br>E | p. 64, l. 57 to p. 65, l. 1 |
| Gradation Controlling Agent | p. 188, right lower column, ll. 4 to 8 | — | — |
| Antistaining Agent | p. 188, right lower column, l. 9 to p. 193, right lower column, l. 10 | p. 37, left upper column, last line to right lower column, l. 13 | p. 65, l. 32 to p. 66, l. 17 |

TABLE 4

| Photographic Constitutional Element | JP-A-62-215272 | JP-A-2-33144 | EP-A-355660 |
|---|---|---|---|
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |

TABLE 5

| Photographic Constitutional Element | JP-A-62-215272 | JP-A-2-33144 | EP-A-355660 |
|---|---|---|---|
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note)
References in column JP-A-62-215272 include contents amended by The Amendment dated March 16, 1987, which appears at the end of the Patent Publication.
Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

Preferred cyan couplers for use in the present invention include diphenylimidazole based cyan couplers disclosed in JP-A-2-33144, 3-hydroxypyridine based cyan couplers disclosed in EP-A-333185, cyclic active methylene based cyan couplers disclosed in JP-A-64-32260, pyrrolopyrazole type cyan couplers disclosed in EP-A-456226, pyrroloimidazole type cyan couplers disclosed in European Patent 484909, and pyrrolotriazole type cyan couplers disclosed in European Patent 488248 and EP-A-491197. The use of pyrrolotriazole type cyan couplers is particularly preferred above all.

Examples of magenta couplers which can be used in the present invention include 5-pyrazolone based magenta couplers and pyrazoloazole type couplers disclosed in the known literature in the above table. In view of hue, image stability and color forming ability, the pyrazolotriazole couplers to which a secondary or tertiary alkyl group is directly bonded at the 2-, 3- or 6-position of the pyrazolotriazole ring disclosed in JP-A-61-65245, the pyrazoloazole couplers which contain a sulfonamide group in the molecule disclosed in JP-A-61-65246, the pyrazoloazole couplers which have an alkoxyphenylsulfonamide ballast group disclosed in JP-A-61-147254, and the pyrazoloazole couplers which have an alkoxyl group or an aryloxy group at the 6-position disclosed in EP-A-226849 and EP-A-294785, are preferably used above all.

As the yellow couplers, in addition to the compounds disclosed in the above table, the acylacetamide type yellow couplers the acyl groups of which have 3- to 5-membered cyclic structures disclosed in EP-A-447969, the malondianilide type yellow couplers having cyclic structures disclosed in EP-A-482552, the acylacetamide type yellow couplers having dioxane structures disclosed in U.S. Pat. No. 5,118,599 are preferably used. Of these, the acylacetamide type yellow coupler in which the acyl group is a 1-alkylcyclopropane-1-carbonyl group and the malondianilide type yellow coupler in which one anilide constitutes an indoline ring are particularly preferably used. These couplers may be used alone or in combination.

The present invention aims at the processing including rapid development, that is, the developing time of 45 seconds or less, further, the color developing time of from 5 seconds to 30 seconds are preferred. The total processing time from the beginning of development until the termination of drying is preferably from 10 to 120 seconds. Particularly preferred developing time is from 10 seconds to 25 seconds.

The preferred total processing time is from 25 seconds to 100 seconds. If such rapid development becomes feasible, any processing conditions of pH and temperature can be applied, in general the pH is 10.0 or more and the temperature is 30° C. or more but preferably the pH is 10.20 or more and the temperature is 40° C. or more for securing stable and sure rapid development. Further, the upper limit of the pH is 12 or so in view of the stabilization of processing and the capability of a buffer and the upper limit of the temperature is decided from the evaporation, oxidation, stability of the processing solution and the like and is 55° or less. More preferably, the pH is within the range of from 10.20 to 11.5 and the temperature is from 40° to 50° C.

In the processing method of the present invention, when the amount of a developing agent in a color developing solution is from 12 to 120 mmol/liter and the color development temperature is from 40° to 50° C., super rapid processing becomes possible and the generation of stain immediately after processing and aging can be prevented. In addition, the desilvering processing time is preferably within 20 seconds or less.

Moreover, the processing time in the present invention means the time for the photographic material to reside in processing solutions.

In the processing method of the present invention, although the above-described effects can be obtained with the condition of the reduced replenishing rate, the replenishing rate of the developing solution and the bleach-fixing solution or the fixing solution is preferably 120 ml or less, more preferably from 15 to 60 ml, per $m^2$. Further, the processing without replenishing is preferred (the evaporated water may be compensated).

It is preferred to contain a stilbene based brightening agent in the photographic material and the processing solutions of the present invention because it has the capability of dissolving out sensitizing dyes, etc., during processing and it per se heightens the whiteness degree. Various stilbene based brightening agents can be used, above all, a bis (triazylylamino)stilbene based brightening agent is preferred and the brightening agent represented by formula (VI) is particularly preferred:

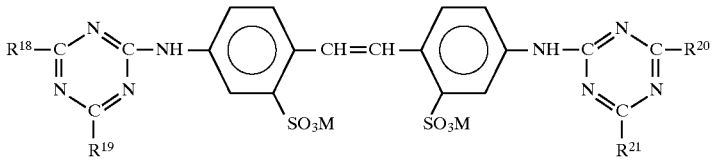

(VI)

wherein $R^{18}$, $R^{19}$, $R^{20}$ and $R^{21}$ each represents a hydroxyl group, a halogen atom, a morpholino group, an alkyl group, an alkoxyl group, an aryloxy group, an aryl group, an amino group, an alkylamino group, or an arylamino group; and M represents a hydrogen atom, an alkali metal cation or a quaternary ammonium ion.

With respect to these groups, a halogen atom represents chlorine or bromine; an alkyl group represents methyl, ethyl or propyl; an alkoxyl group represents methoxy or ethoxy; an aryloxy group represents phenoxy or methoxyphenoxy; an aryl group represents phenyl or methoxyphenyl; an alkylamino group represents methylamino, ethylamino, propylamino, butylamino, dimethylamino, cyclohexylalmino, β-hydroxyethylamino, di(β-hydroxyethyl)amino, β-sulfoethylamino, N-(β-sulfoethyl)-N'-methylamino, or N-(β-hydroxyethyl)-N'-methylamino; and arylamino represents anilino, o-, m-, p-sulfoanilino, disulfoanilino, o-, p-, m-chloroanilino, o-, m-, p-toluidino, o-, m-, p-carboxyanilino, dicarboxyanilino, o-, m-, p-hydroxyanilino, sulfonaphthylamino, o-, m-, p-aminoanilino, or o-, m-, p-anisidino.

With respect to M, an alkali metal cation represents potassium, sodium, cesium or lithium.

Of the above, particularly preferably $R^{18}$, $R^{19}$, $R^{20}$ and $R^{21}$ each represents a methoxy group, a β-hydroxyethylamino group, a di(β-hydroxyethyl)amino group, or a sulfoethylamino group, and M represents sodium.

Specific examples of stilbene based brightening agents for use in the present invention are shown below, but the present invention is not limited thereto.

(F-1)
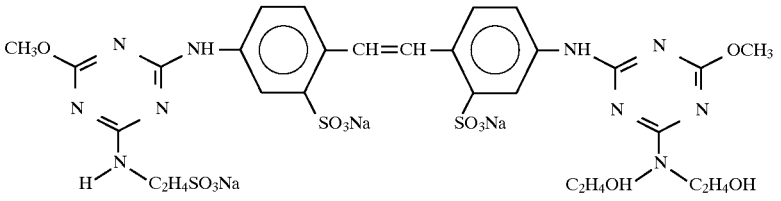
(F-2)
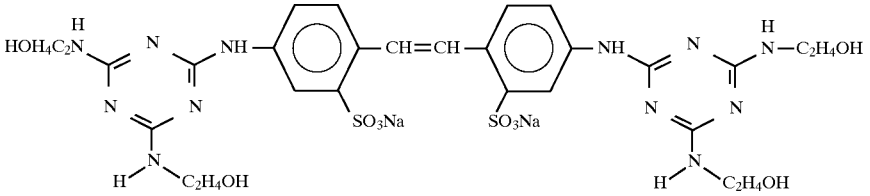
(F-3)
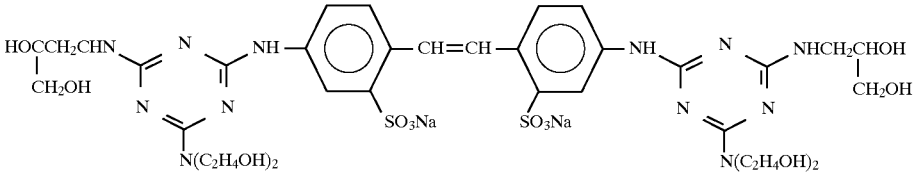
(F-4)
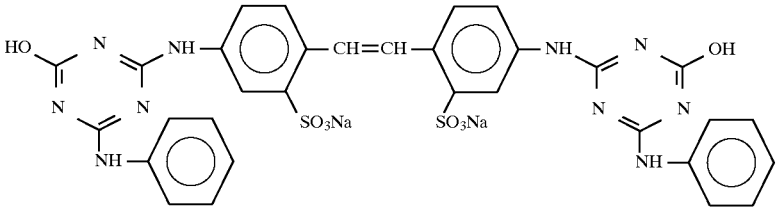
(F-5)
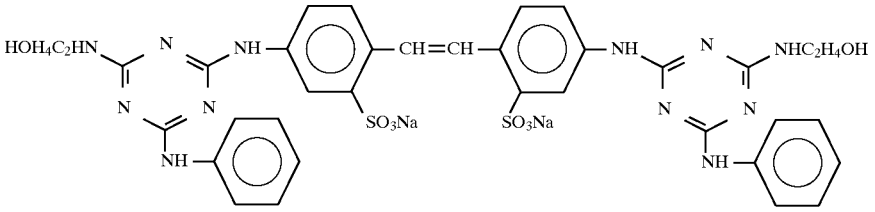
(F-6)
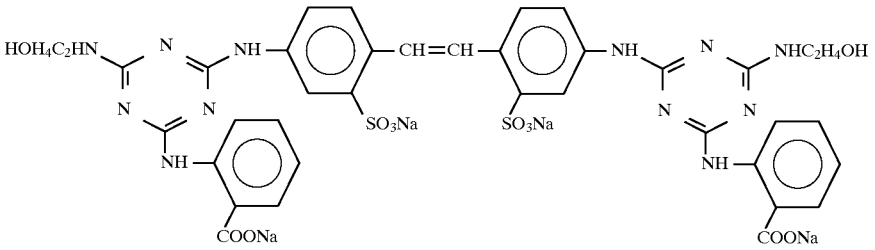
(F-7)
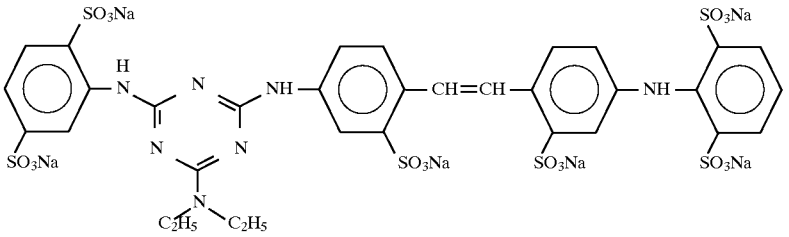

-continued
(F-8)
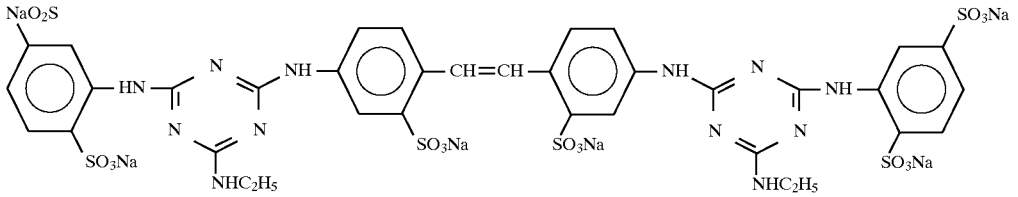
(F-9)
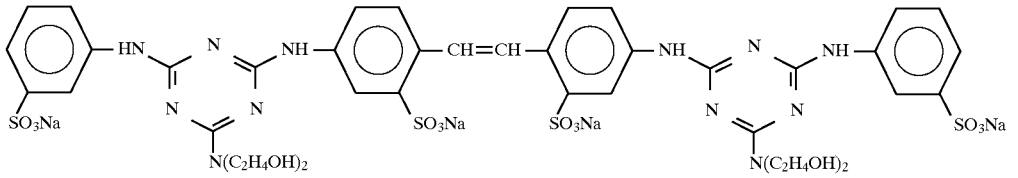
(F-10)
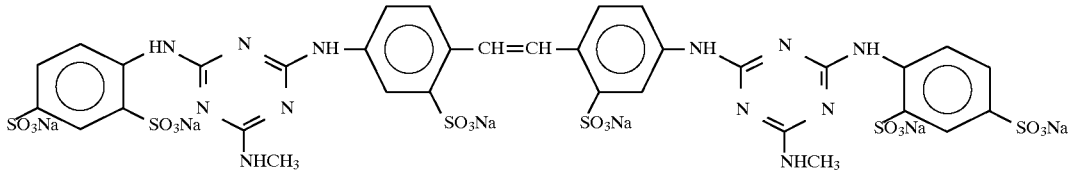
(F-11)
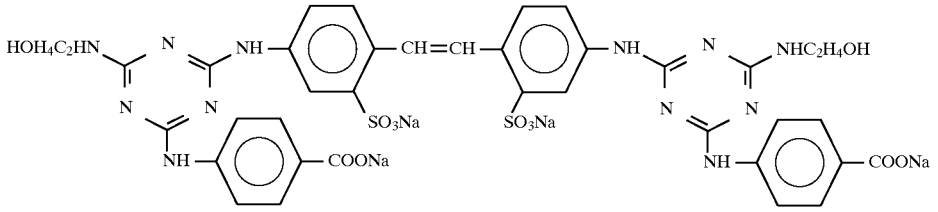
(F-12)
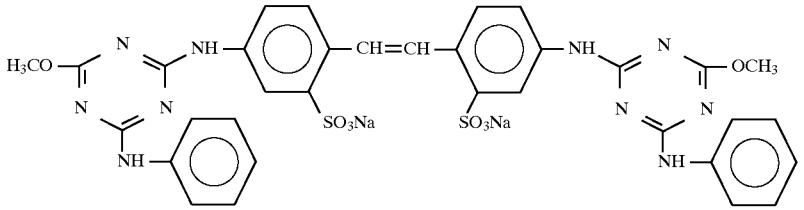
(F-13)
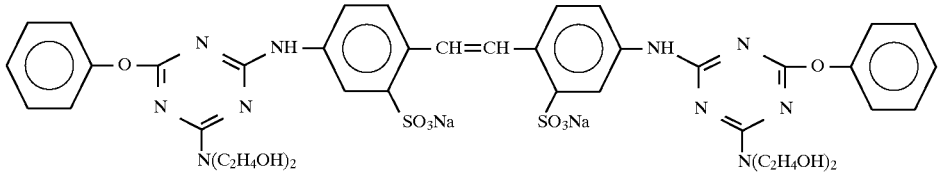
(F-14)
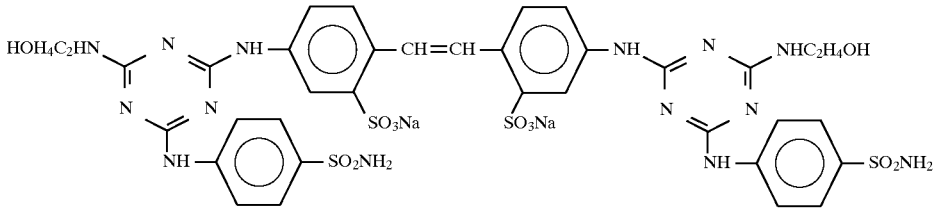
(F-15)
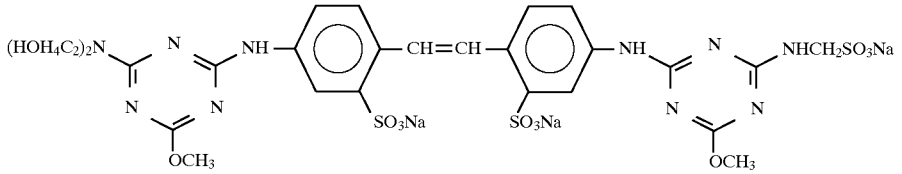

-continued (F-16)

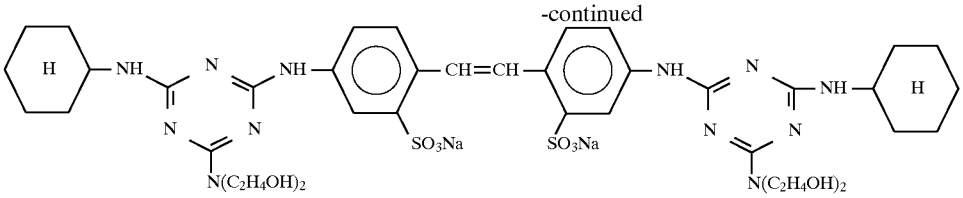

(F-17)

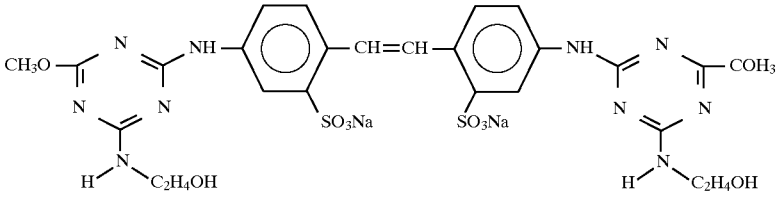

(F-18)

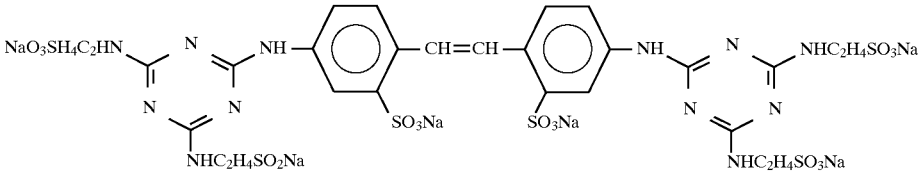

(F-19)

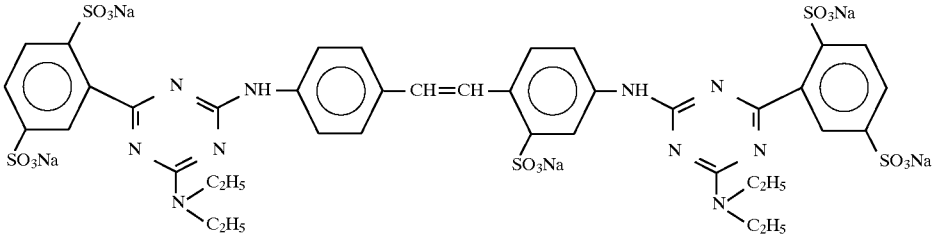

Particularly preferred stilbene based brightening agents are those having the structures of F-1 and F-18.

Any of the above shown stilbene based brightening agents are well known compounds and easily available or can be synthesized according to known methods.

When these stilbene based brightening agents are added to a desilvering solution, the addition amount is preferably from $1\times10^{-4}$ to $5\times10^{-2}$ mol/liter, more preferably from $2\times10^{-4}$ to $1\times10^{-2}$ mol/liter. The brightening agent may be added to a desilvering solution in the above amount, or may be contained in a photographic material or may be added to a color developing solution such that the prescribed amount should be contained. When the stilbene based brightening agent is previously incorporated into a photographic material, the addition amount is generally from 10 mg/m$^2$ to 100 mg/m$^2$, preferably from 20 Mg/m$^2$ to 60 mg/m$^2$.

The processing method of the present invention specifically comprises imagewise exposing a photographic material, color development processing, desilvering processing, in general, washing and/or stabilization processing, and drying processing.

In addition to the processing methods described in the above table, the processing methods and the processing materials disclosed in line 1, right lower column, page 26 to line 9, right upper column, page 34 of JP-A-2-207250 and line 17, left upper column, page 5 to line 20, right lower column, page 18 of JP-A-4-97355 can be preferably used as the processing method of the color photographic material of the present invention.

The present invention is described in detail with reference to the examples, but it should not be construed as being limited thereto.

EXAMPLE 1

Preparation of Support A

Fifteen (15) wt % of titanium dioxide was added to a low density polyethylene having MFR of 3, 3.0 wt % of zinc stearate based on the amount of the titanium dioxide was added thereto, the mixture was kneaded in a Banbury mixer at 200° C. together with an ultramarine blue dye (DV-1 manufactured by Daiichi Kasei Kogyo K.K.), and the molten mixture was melt extruded to prepare master pellets (designated Master Pellet A).

The size of the titanium dioxide used was confirmed to be from 0.15 $\mu$m to 0.35 $\mu$m under an electron microscope, and the titanium dioxide was coated with aluminum oxide hydrate in an amount of 0.3 wt % based on titanium dioxide in the form of $Al_2O_3$ and with trimethylolethane in an amount of 0.5 wt % based on titanium dioxide.

After a paper substrate having a basis weight of 170 g/m$^2$ was corona discharged at 10 kVA, a mixture of the above polyethylene composition containing 15 wt % of titanium dioxide and a polyethylene composition containing an ultramarine blue dye but not containing titanium dioxide was melt extruded at 320° C. using an extrusion coating die on the above paper substrate to obtain a polyethylene laminate layer having a thickness of 30 $\mu$m. The content of the titanium dioxide was 12 wt % based on the polyethylene. The surface of the polyethylene layer was glow discharged.

Preparation of Support

Supports (Supports B to P) were prepared in the same manner as above using the same Master Pellet A except that the brightening agent according to the present invention was kneaded together with Master Pellet A. The brightening agents used are shown in Table 6 below.

TABLE 6

| Support No. | Brightening Agent | Coating Amount ($mg/m^2$) |
|---|---|---|
| A | None | 12.5 |
| B | I-(1) | 12.5 |
| C | I-(2) | 12.5 |
| D | I-(3) | 12.5 |
| E | I-(4) | 12.5 |
| F | I-(13) | 12.5 |
| G | II-(2) | 12.5 |
| H | II-(6) | 12.5 |
| I | II-(7) | 12.5 |
| J | III-(6) | 12.5 |
| K | III-(8) | 12.5 |
| L | III-(9) | 12.5 |
| M | IV-(1) | 12.5 |
| N | IV-(6) | 12.5 |
| O | V-(3) | 12.5 |
| P | V-(5) | 12.5 |

Preparation of Photographic Material Nos. 101A to P

Various photographic constitutional layers were coated on the above reflective support and multilayer color photographic papers (Nos. 101A to P) having the layer constitution shown below were prepared. (The photographic constitutional layers excluding the support was designated Photographic Material No. 101.) The coating solution was prepared as follows.

Preparation of Coating Solution for Third Layer

Forty (40.0) g of a magenta coupler (ExM), 32.5 g of an ultraviolet absorber (UV-2), 7.5 g of a color image stabilizer (Cpd-2), 25.0 g of a color image stabilizer (Cpd-5), 2.5 g of a color image stabilizer (Cpd-6), 20.0 g of a color image stabilizer (Cpd-7), 2.5 g of a color image stabilizer (Cpd-8), 5.0 g of a color image stabilizer (Cpd-10) were dissolved in a mixture of 20.0 g of a solvent (Solv-10), 50.0 g of a solvent (Solv-4), 25.0 g of a solvent (Solv-6), 45.0 g of a solvent (Solv-12) and 110 ml of ethyl acetate, and this solution was dispersed in an emulsified condition in 1,500 g of a 7% aqueous gelatin solution containing 90 ml of a 10% aqueous sodium dodecylbenzenesulfonate solution to obtain Emulsified Dispersion A. On the other hand, silver chlorobromide Emulsion B-1 was prepared (a cubic form, a mixture in a ratio of 1/3 (silver mol ratio) of a large grain size emulsion having an average grain size of 0.55 $\mu$m, and a small grain size emulsion having an average grain size of 0.39 $\mu$m; variation coefficients of the grain size distribution were 0.08 and 0.06, respectively, both of them contained 0.8 mol % of silver bromide localized at a part of the grain surface, and the remaining substrate being comprising silver chloride, and potassium hexachloroiridate-(IV) in the total amount of 0.1 mg and potassium ferrocyanide in the total amount of 1.0 mg, respectively, were contained in the inside and at the silver bromide localized phase of the grain). The green-sensitive Sensitizing Dyes D, E and F shown below were added in an amount of $3.0\times10^{-4}$ mol, $4.0\times10^{-5}$ mol and $2.0\times10^{-4}$ mol, respectively, per mol of silver, to the large grain size emulsion, and $3.6\times10^{-4}$ mol, $7.0\times10^{-5}$ mol and $2.8\times10^{-4}$ mol, respectively, per mol of silver, to the small grain size emulsion. Subsequently, chemical sensitization was conducted optimally by the addition of a sulfur sensitizer (triethylthiourea) and a gold sensitizer (chloroauric acid) in the presence of the decomposition product of a nucleic acid. The foregoing Emulsified Dispersion A was mixed with this silver chlorobromide Emulsion B-1 and the mixture was dissolved to obtain a coating solution for the third layer having the composition described below.

The coating solutions for the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12 and Cpd-13 were added to each layer so that the total coating amount became 25.0 $mg/m^2$ and 50.0 $mg/m^2$, respectively.

The grain size of the silver chlorobromide emulsion of each light-sensitive emulsion layer was adjusted in the same preparation method as the above silver chlorobromide Emulsion B-1 and after the spectral sensitizing dyes described below were added, amounts of a sulfur sensitizer (triethylthiourea) and a gold sensitizer (chloroauric acid) were adjusted and chemical sensitization was conducted optimally.

Sensitizing Dyes for Blue-Sensitive Emulsion Layer:

Sensitizing Dye A

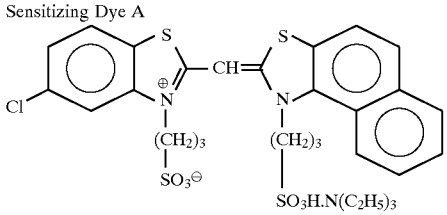

Sensitizing Dye B

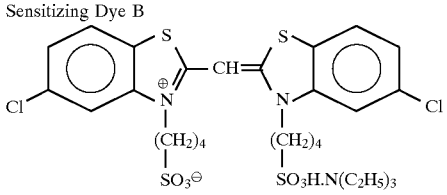

Sensitizing Dye C

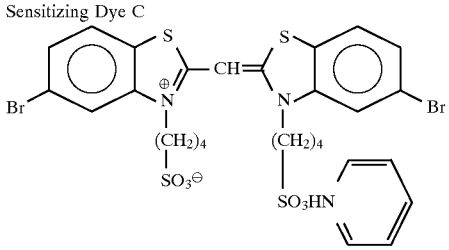

(each in an amount of $1.4\times10^{-4}$ mol per mol of the silver halide to the large grain size emulsion, and each in an amount of $1.7\times10^{-4}$ mol per mol of the silver halide to the small grain size emulsion)

Sensitizing Dyes for Green-Sensitive Emulsion Layer:

Sensitizing Dye D

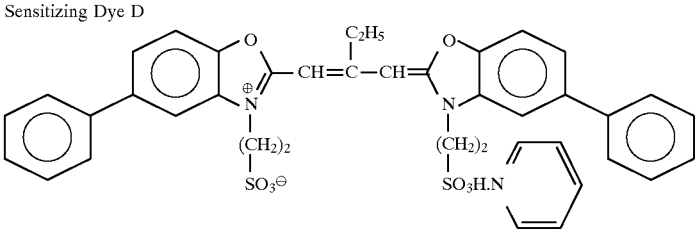

Sensitizing Dye E

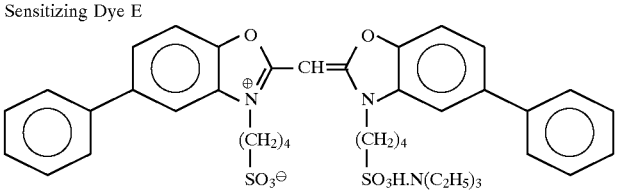

Sensitizing Dye F

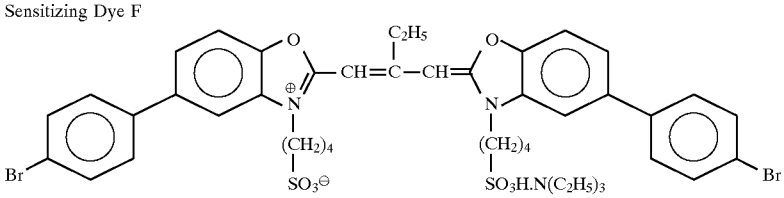

Sensitizing Dyes for Red-Sensitive Emulsion Layer:

Sensitizing Dye G

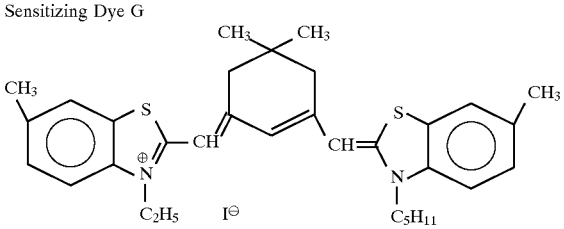

(in an amount of $4.0\times10^{-5}$ mol per mol of the silver halide to the large grain size emulsion and in an amount of $5.0\times10^{-5}$ mol per mol of the silver halide to the small grain size emulsion)

Sensitizing Dye H

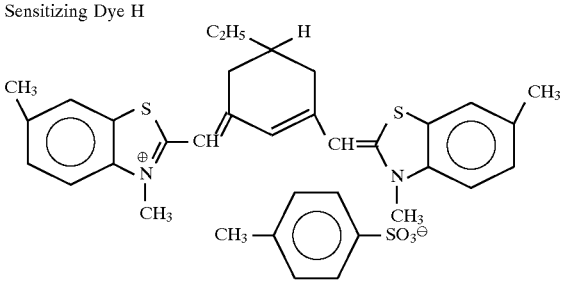

(in an amount of $5.0\times10^{-5}$ mol per mol of the silver halide to the large grain size emulsion and in an amount of $6.0\times10^{-5}$ mol per mol of the silver halide to the small grain size emulsion)

Further, the following compound was added to the red-sensitive silver halide emulsion in an amount of $2.6\times10^{-3}$ mol per mol of the silver halide.

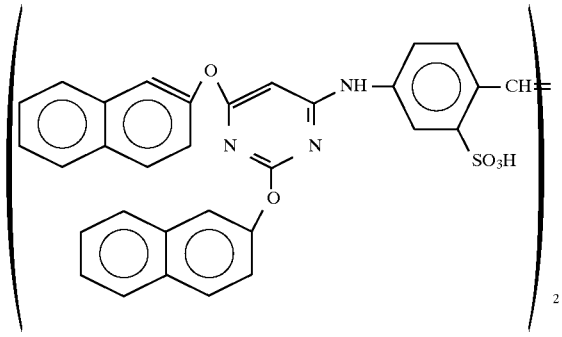

Further, 1-(5-methylureidophenyl)-5-mercaptotetrazole was added to the blue-sensitive emulsion layer, the green-sensitive emulsion layer and the red-sensitive emulsion layer in an amount of $8.5\times10^{-4}$ mol, $3.0\times10^{-3}$ mol and $2.5\times10^{-4}$ mol, respectively, per mol of the silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-6}$ mol, respectively, per mol of the silver halide.

Moreover, the following compounds were added to the sixth layer as irradiation preventing water-soluble dyes.

Yellow Dye

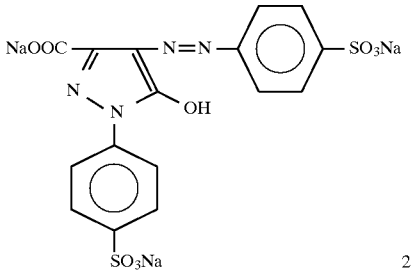

2 mg/m²

-continued

Magenta Dye

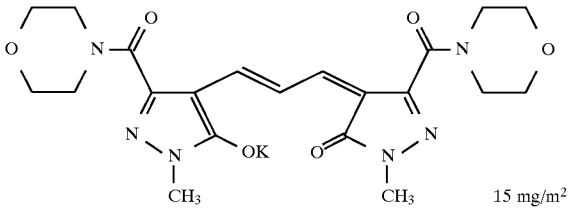

15 mg/m²

Cyan Dye
A mixture of:

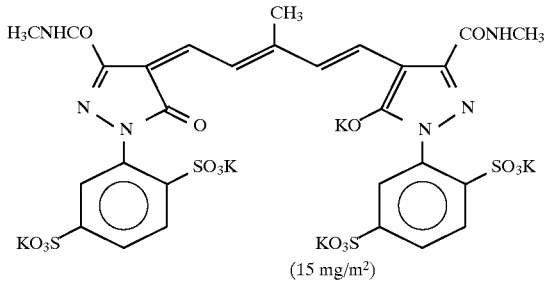

(15 mg/m²)

and

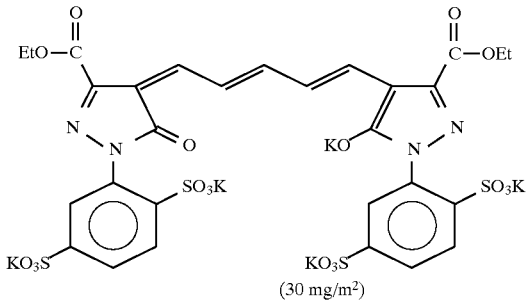

(30 mg/m²)

Layer Composition

The composition of each layer is described below. The numeral represents the coating amount (g/m²). The numeral for silver halide emulsion represents the coating amount in terms of silver.

Support A

First Layer (blue-sensitive emulsion layer)

| | |
|---|---|
| Silver Chlorobromide Emulsion A-1 | 0.27 |

(a cubic form, a mixture in a ratio of 5/5 (silver mol ratio) of a large grain size emulsion having an average grain size of 0.88 μm and a small grain size emulsion having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride, and potassium hexachloroiridate (IV) in the total amount of 0.1 mg and potassium ferrocyanide in the total amount of 1.0 mg, respectively, were contained in the inside and at the silver bromide localized phase of the grain)

| | |
|---|---|
| Gelatin | 1.24 |
| Yellow Coupler (EXY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.01 |
| Solvent (Solv-1) | 0.22 |

Second Layer (color mixture Preventing layer)

| | |
|---|---|
| Gelatin | 1.14 |
| Color Mixing Preventive (Cpd-4) | 0.08 |
| Solvent (Solv-1) | 0.07 |
| Solvent (Solv-2) | 0.29 |
| Solvent (Solv-10) | 0.17 |

Third Layer (green-sensitive emulsion layer)

| | |
|---|---|
| Silver Chlorobromide Emulsion B-1 described above | 0.13 |
| Gelatin | 1.31 |
| Magenta Coupler (EXM) | 0.16 |
| Ultraviolet Absorber (Uv-2) | 0.13 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |
| Color Image Stabilizer (Cpd-10) | 0.02 |
| Solvent (Solv-10) | 0.08 |
| Solvent (Solv-4) | 0.20 |
| Solvent (Solv-6) | 0.10 |
| Solvent (Solv-12) | 0.18 |

Fourth Layer (color mixture preventing layer)

| | |
|---|---|
| Gelatin | 0.82 |
| Color Mixing Preventive (Cpd-4) | 0.06 |
| Solvent (Solv-1) | 0.05 |
| Solvent (Solv-2) | 0 20 |
| Solvent (Solv-10) | 0.12 |

Fifth Layer (red-sensitive emulsion layer)

| | |
|---|---|
| Silver Chlorobromide Emulsion C-1 | 0.18 |

(a cubic form, a mixture in a ratio of 1/4 (silver mol ratio) of a large grain size emulsion having an average grain size of 0.50 μm and a small grain size emulsion having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride, and further, potassium hexachloroiridate(IV) in the total amount of 0.3 mg and potassium ferrocyanide in the total amount of 1.5 mg, respectively, per mol of the silver were contained in the inside and at the silver bromide localized phase of the grain)

| | |
|---|---|
| Gelatin | 0.91 |
| Cyan Coupler (EXC) | 0.26 |
| Ultraviolet Absorber (UV-2) | 0.18 |
| Color Image Stabilizer (Cpd-1) | 0.21 |
| Color Image Stabilizer (Cpd-2) | 0.03 |
| Color Image Stabilizer (Cpd-6) | 0.01 |
| Color Image Stabilizer (Cpd-8) | 0.01 |
| Color Image Stabilizer (Cpd-9) | 0.02 |
| Color Image Stabilizer (Cpd-10) | 0.01 |
| Solvent (Solv-7) | 0.22 |

Sixth Layer (ultraviolet absorbing layer)

| | |
|---|---|
| Gelatin | 0.75 |
| Ultraviolet Absorber (UV-1) | 0.33 |
| Color Image Stabilizer (Cpd-5) | 0.01 |
| Color Image Stabilizer (Cpd-7) | 0.05 |
| Solvent (Solv-11) | 0.18 |

Seventh Layer (protective layer)

| | |
|---|---|
| Gelatin | 1.00 |
| Acryl-Modified Copolymer of Polyvinyl Alcohol (modification degree: 17%) | 0.05 |
| Liquid Paraffin | 0.02 |
| Color Image Stabilizer (Cpd-11) | 0.01 |

The compounds used for preparing the composition of each layer described above are shown below.

(ExY) Yellow Coupler

1/1 mixture by mol ratio of

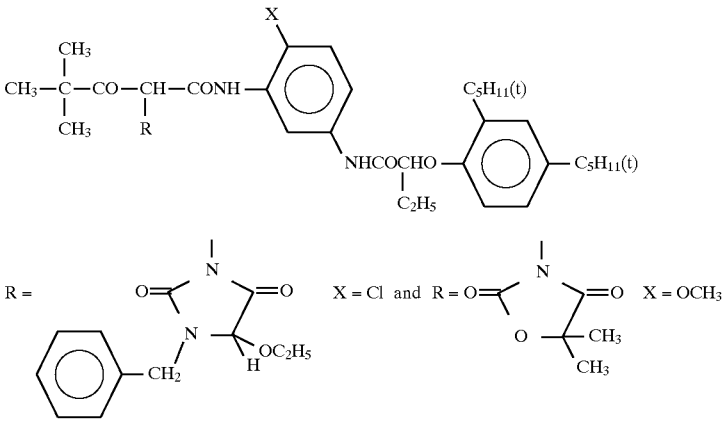

(ExM) Magenta Coupler

1/1 mixture by mol ratio of

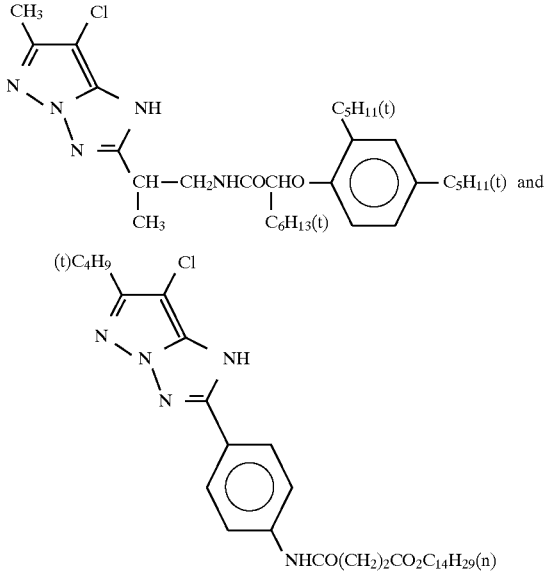

(ExC) Cyan Coupler

25/75 mixture by mol ratio of

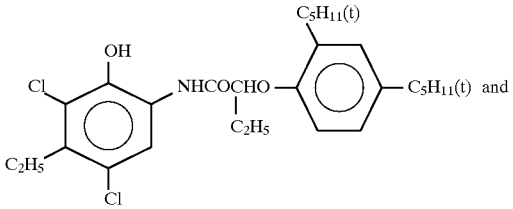

-continued

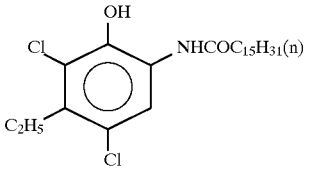

(Cpd-1) Color Image Stabilizer

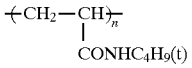

average molecular weight: 60,000

(Cpd-2) Color Image Stabilizer

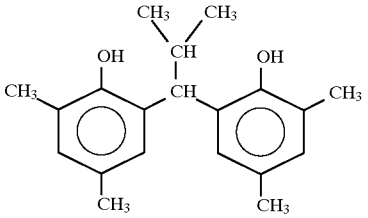

(Cpd-3) Color Image Stabilizer

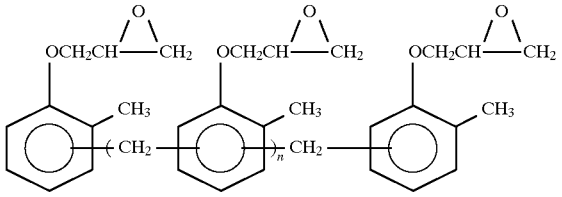

n=7–8 (average value)

(Cpd-4) Color Mixing Preventive

1/1/1 mixture by weight ratio of

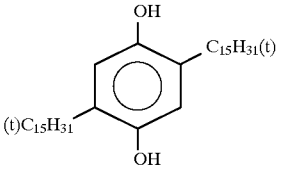

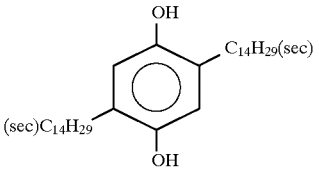

and

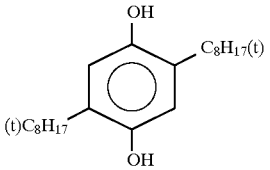

(Cpd-5) Color Image Stabilizer

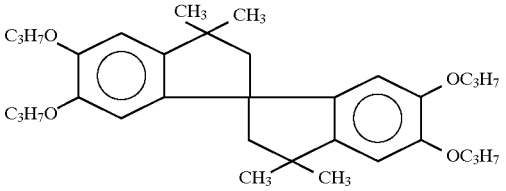

(Cpd-6) Color Image Stabilizer

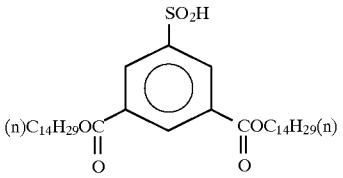

(Cpd-7) Color Image Stabilizer

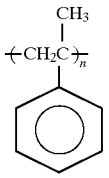

number average molecular weight: 600

(Cpd-8) Color Image Stabilizer

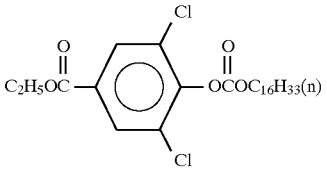

(Cpd-9) Color Image Stabilizer

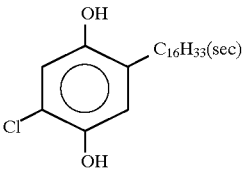

(Cpd-10) Color Image Stabilizer

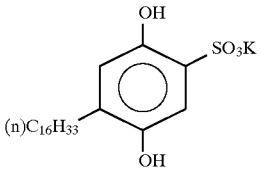

(Cpd-11) Color Image Stabilizer
1/2/1 mixture by weight ratio of i)/ii)/iii)
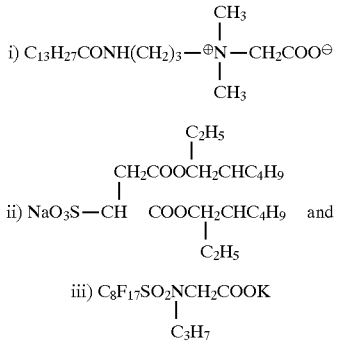
(Cpd-12) Preservative
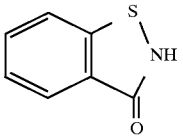
(Cpd-13) Preservative
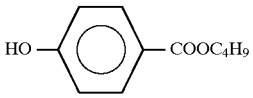
(UV-1) UV Absorber
12/10/12/35/17 mixture by weight ratio of (iv)/(v)/(vi)/(vii)/(viii)
(iv)
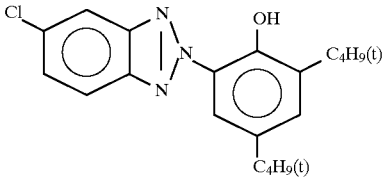
(v)
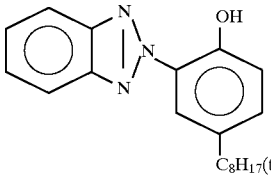
(vi)
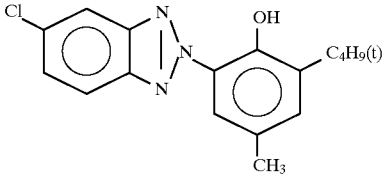
-continued
(vii)
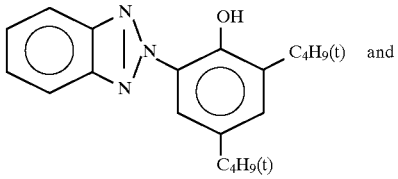
(viii)
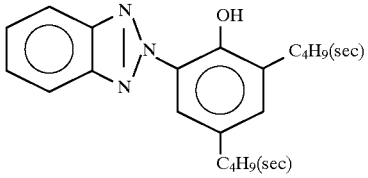
(UV-2) UV Absorber
2/2/5/2 mixture by weight ratio of (ix)/(x)/(xi)/(xii)
(ix)
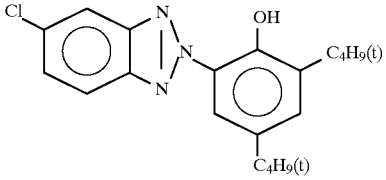
(x)
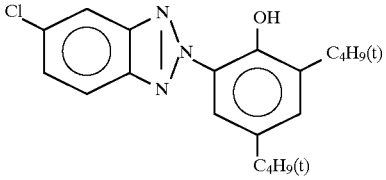
(xi)
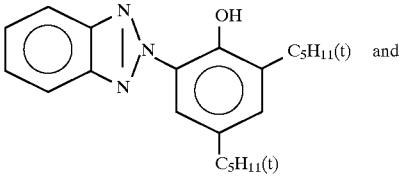
(xii)
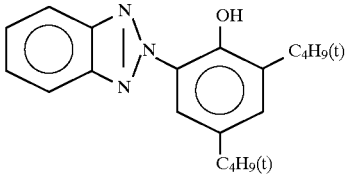
(Solv-1) Solvent
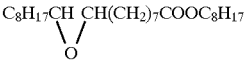

-continued (Solv-2) Solvent

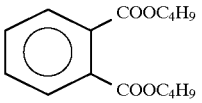

(Solv-3) Solvent

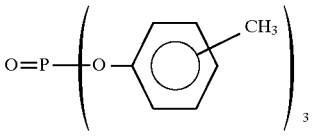

(Solv-4) Solvent $O{=}P{-}(O{-}C_6H_{13}(n))_3$ (Solv-6) Solvent

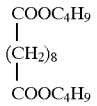

(Solv-7) Solvent

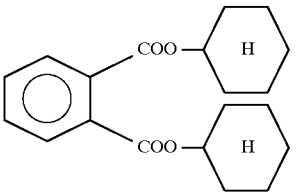

(Solv-9) Solvent

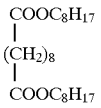

(Solv-10) Solvent

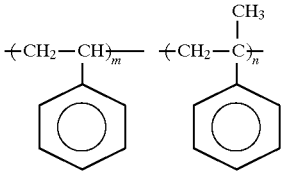

m/n = 10/90 by mole
average molecular weight: 590

(Solv-11) Solvent

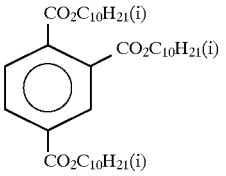

-continued (Solv-12) Solvent

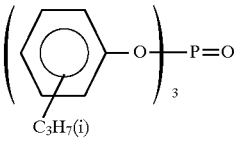

Sample Nos. 101B to 101P were prepared in the same manner as the preparation of Sample No. 101A except that the support was replaced with each one of Supports B to P.

The following evaluation was conducted using the obtained samples after the hardening reaction was finished. Each of Sample Nos. 101A to 101P was running processed using the color developing solution of the same prescription at the following replenishing rate in proportion of 25% of fogged sample by white light exposure and 75% of unexposed sample.

| Step | Processing Temperature (°C.) | Processing Time (sec) | Replenishment Rate* (ml) | Tank Capacity (ml) |
|---|---|---|---|---|
| Color Development | 38.5 | 45 | 45 | 500 |
| Bleach-Fixing | 30–35 | 45 | 60 | |
| Rinsing (1) | 30–35 | 20 | | |
| Rinsing (2) | 30–35 | 20 | | |
| Rinsing (3) | 30–35 | 20 | | |
| Drying | 70–80 | 60 | | |

*Replenishing rate per $m^2$ of the photographic material
Rinsing was conducted in a 3-tank countercurrent system from rinsing (3) to rinsing (1).

The composition of each processing solution was as follows.

| Color Developing Solution | Tank Solution | Replenisher |
|---|---|---|
| Water | 700 ml | 700 ml |
| Sodium Triisopropylene(β)-sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 10.0 g | 13.0 g |
| N-Ethyl-N-(β-methanesulfon-amidoethyl)-3-methyl-4-aminoaniline Sulfate | 5.0 g | 11.5 g |
| Water to make | 1,000 ml | 1,000 ml |
| pH (25° C.) | 10.0 | 11.0 |

Bleach-Fixing Solution (the tank solution and the replenisher are the same)

| | |
|---|---|
| Water | 600 ml |
| Ammonium Thiosulfate (700 g/liter) | 100 ml |
| Ammonium Sulfite | 40 g |
| Ammonium Ethylenediaminetetraacetato | 55 g |

-continued

| | |
|---|---|
| Ferrate | |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 5.8 |

Rinsing Solution (the tank solution and the replenisher are the same)

Ion Exchange Water (each concentration of calcium and magnesium is 3 ppm or less)

Before and after continuous processing, sensitometry was conducted using each sample. Development processing was conducted after each sample was exposed using a sensitometer (FWH type, color temperature of the light source: 3,200° K., a product of Fuji Photo Film Co., Ltd.) through a color separation filter and a gradation wedge.

Further, the processed sample was preserved at 70° C., 70% RH for 7 days. Spectra of each sample by monochromatic light irradiation or white light irradiation were measured using a color analyzer C-2000 (manufactured by Hitachi, Ltd.), and the change of b* (Δb*) of monochromatic light irradiation and white light irradiation based on CIE1976 color specification system was shown in Table 7. Evaluation was conducted with light sources of tungsten light and xenon light. It is generally preferred that the value to be obtained is about −4.0 or more, and the absolute value thereof is larger. Further, it is generally said that the less the differences of the values of Δb* between before processing (Fr) and after continuous processing or after preservation, the more excellent is the stability of whiteness degree of white background.

ing the upper layer of 11 μm (titanium dioxide: 20%) and the lower layer of 17 μm (titanium dioxide: 0 wt %) was prepared.

Preparation of Support No. A30

By extrusion on the paper substrate of Support A using a multilayer extrusion coating die, Support No. A30 comprising the upper layer of 1 μm (titanium dioxide: 0%), the intermediate layer of 10 μm (titanium dioxide: 40%) and the lower layer of 16 μm (titanium dioxide: 4%) was prepared.

Preparation of Support Nos. A21 to A25 and A31 to A35

Support Nos. A21 to A25 and A31 to A35 were prepared by coating Brightening Agents I-(3), II-(6), III-(8), IV-(1) and V-(5) on each upper layer of Support No. A20 and Support No. A30, respectively in a coating amount of 15 mg/m$^2$.

Preparation of Support No. S20

Support No. S20 having the same constitution as Support No. A20 was prepared except that titanium dioxide was treated with 0.8 wt % of $Al_2O_3$ and 0.8 wt % of the following compound, each based on the titanium dioxide.

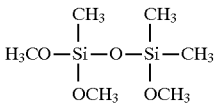

Preparation of Support No. S30

Support No. S30 having the same constitution as Support No. A30 and using the same processed titanium dioxide as used in Support No. S20 was prepared.

Preparation of Support Nos. S21 to S25 and S31 to S35

Support Nos. S21 to S25 and S31 to S35 were prepared by coating Brightening Agents I-(3), II-(6), III-(8), IV-(1) and V-(5) on each upper layer of Support No. S20 and Support No. S30, respectively in a coating amount of 15 mg/m$^2$.

TABLE 7

| | | Δb* (tungsten light) | | | Δb* (xenon light) | | |
|---|---|---|---|---|---|---|---|
| Sample No. | Brightening Agent | Fr | After Continuous Processing | 60° C., 70% RH, 14 Days | Fr | After Continuous Processing | 60° C., 70% RH, 14 Days |
| 101A | None | +0.22 | +0.34 | +0.38 | +0.33 | +0.41 | +0.40 |
| 101B | I-(1) | −0.67 | −0.66 | −0.61 | −1.55 | −1.53 | −1.46 |
| 101C | I-(2) | −0.72 | −0.70 | −0.65 | −1.76 | −1.74 | −1.67 |
| 101D | I-(3) | −0.73 | −0.70 | −0.67 | −1.78 | −1.74 | −0.69 |
| 101E | I-(4) | −0.65 | −0.63 | −0.59 | −1.58 | −1.53 | −1.45 |
| 101F | I-(13) | −0.44 | −0.42 | −0.39 | −1.33 | −1.31 | −1.27 |
| 101G | II-(2) | −0.42 | −0.39 | −0.33 | −1.35 | −1.37 | −1.31 |
| 101H | II-(6) | −0.66 | −0.63 | −0.59 | −1.56 | −1.52 | −1.44 |
| 101I | II-(7) | −0.64 | −0.63 | −0.58 | −1.52 | −1.50 | −1.45 |
| 101J | III-(6) | −0.48 | −0.46 | −0.44 | −1.37 | −1.35 | −1.29 |
| 101K | III-(8) | −0.62 | −0.60 | −0.56 | −1.55 | −1.52 | −1.43 |
| 101L | III-(9) | −0.43 | −0.42 | −0.37 | −1.29 | −1.27 | −1.20 |
| 101M | IV-(1) | −0.69 | −0.66 | −0.62 | −1.55 | −1.53 | −1.46 |
| 101N | IV-(6) | −0.46 | −0.43 | −0.38 | −1.32 | −1.29 | −1.23 |
| 101O | V-(3) | −0.42 | −0.39 | −0.35 | −1.28 | −1.26 | −1.20 |
| 101P | V-(5) | −0.66 | −0.63 | −0.56 | −1.56 | −1.53 | −1.45 |

It can be seen from the results in Table 7 that the constitution of the present invention is excellent in a whiteness degree, in particular, when printed photographs are stored under high temperature and high humidity conditions.

EXAMPLE 2

Preparation of Support No. A20

By extrusion on the paper substrate of Support A using a multilayer extrusion coating die, Support No. A20 comprising The same light-sensitive layers as Sample No. 101A in Example 1 were coated on the above-obtained supports. The name of the obtained photographic material each corresponded to the support name (e.g., the sample prepared by coating on Support No. A20 is Sample A20). Each sample was subjected to the same processing as in Example 1, preserved at 60° C., 70% RH for 14 days. The results obtained are shown in Table 8 below.

TABLE 8

| Sample No. | Δb* (xenon Light Source) After Being Preserved at 60° C., 70% RH, for 14 Days |
|---|---|
| A20 (Comparison) | +0.40 |
| A21 (Invention) | −1.67 |
| A22 (Invention) | −1.46 |
| A23 (Invention) | −1.50 |
| A24 (Invention) | −1.45 |
| A25 (Invention) | −1.47 |
| A30 (Comparison) | +0.41 |
| A31 (Invention) | −2.87 |
| A32 (Invention) | −2.63 |
| A33 (Invention) | −2.72 |
| A34 (Invention) | −2.68 |
| A35 (Invention) | −2.70 |
| S20 (Comparison) | +9.43 |
| S21 (Invention) | −1.87 |
| S22 (Invention) | −1.63 |
| S23 (Inventidn) | −1.70 |
| S24 (Invention) | −1.65 |
| S25 (Invention) | −1.68 |
| S30 (Comparison) | +0.42 |
| S31 (Invention) | −3.40 |
| S32 (Invention) | −3.18 |
| S33 (Invention) | −3.23 |
| S34 (Invention) | −3.25 |
| S35 (Invention) | −3.22 |

As is apparent from the results in Tables 7 and 8, the effect of improvement by the constitution of the present invention is large, in particular, the absolute value of Δb* is increased is increased and a whiteness degree is further improved by making the polyethylene laminated layer of the support to three layers.

EXAMPLE 3

The following portions of Photographic Material No. 101 were changed and each constitutional layer was coated on Supports A, B, H, K, M and P in Example 1 to obtain samples (the formulation of photographic material was made as 301 and the number of the photographic material corresponded to the support number, e.g., 301A).

| | | Coated Amount of Silver |
|---|---|---|
| First Layer | Silver chlorobromide emulsion A-1 | 0.37 |
| Third Layer | Silver chlorobromide emulsion B-1 | 0.18 |
| Fifth Layer | Silver chlorobromide emulsion C-1 | 0.20 |
| | Total Coated Amount of Silver | 0.75 g/m$^2$ |

Exposure, continuous processing and evaluation were conducted in the same manner as in Example 1. The results obtained are shown in Table 9 below.

TABLE 9

| Sample No. | Δb* (Xenon Light Source) At the Time of Termination of Continuous Processing |
|---|---|
| 301A (Comparison) | +0.42 |
| 301B (Comparison) | −1.42 |
| 301H (Invention) | −1.42 |
| 301K (Invention) | −1.45 |

TABLE 9-continued

| Sample No. | Δb* (Xenon Light Source) At the Time of Termination of Continuous Processing |
|---|---|
| 301M (Invention) | −1.40 |
| 301P (Invention) | −1.41 |

From the results in Table 9, it can be understood that in Sample Nos. 101H, 101K, 101M and 101P in which the coating amounts of silver are reduced, the absolute values of Δb* are larger than those in the corresponding Sample Nos. 301H, 301K, 301M and 301P, therefore, the effect of the present invention is large.

Further, comparative samples were prepared by replacing silver chlorobromide emulsions A-1, B-1 and C-1 in Example 1 with a silver chlorobromide emulsion containing 80 wt % of silver chloride and the same processing in Example 1 was conducted. As a result, sufficient yellow density could not be obtained and the developing time of 45 seconds could not complete image formation, therefore, it can be seen that the high quality image cannot be obtained.

EXAMPLE 4

The following portions of Photographic Material No. 101 were changed and samples were prepared by coating each constitutional layer on Supports A, C and H in Example 1 (Photographic Material Sample Nos. 401A, 401C and 401H).

| | |
|---|---|
| Third Layer (green-sensitive emulsion layer) | |
| Silver Chlorobromide Emulsion B-1 described above | 0.13 |
| Gelatin | 1.29 |
| Magenta Coupler (ExM) | 0.18 |
| Ultraviolet Absorber (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fifth Layer (red-sensitive emulsion layer) | |
| Silver Chlorobromide Emulsion C-1 (a cubic form, a mixture in a ratio of ¼ (silver mol ratio) of a large grain size emulsion having an average grain size of 0.50 μm and a small grain size emulsion having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride, and further, potassium hexachloroiridate(IV) in the total amount of 0.3 mg and potassium ferrocyanide in the total amount of 1.5 mg, respectively, per mol of the silver were contained in the inside and at the silver bromide localized phase of the grain) | 0.18 |
| Gelatin | 0.91 |
| Cyan Coupler (ExC) | 0.33 |
| Ultraviolet Absorber (UV-2) | 0.18 |
| Color Image Stabilizer (Cpd-1) | 0.33 |
| Color Image Stabilizer (Cpd-2) | 0.03 |
| Color Image Stabilizer (Cpd-6) | 0.01 |
| Color Image Stabilizer (Cpd-8) | 0.01 |
| Color Image Stabilizer (Cpd-9) | 0.02 |

-continued

| | |
|---|---|
| Color Image Stabilizer (Cpd-10) | 0.01 |
| Solvent (Solv-1) | 0.01 |
| Solvent (Solv-7) | 0.22 |
| Sixth Layer (ultraviolet absorbing layer) | |
| Gelatin | 0.48 |
| Ultraviolet Absorber (UV-3) | 0.38 |
| Color Image Stabilizer (Cpd-5) | 0.01 |
| Color Image Stabilizer (Cpd-7) | 0.05 |
| Solvent (Solv-9) | 0.05 |

The compounds used for preparing the composition of each layer described above are the same as those as shown in Example 1 above or shown below.

(UV-3) UV Absorber

1/2/2/3/1 mixture by weight ratio of (iv)/(v)/(vi)/(vii)/(viii)

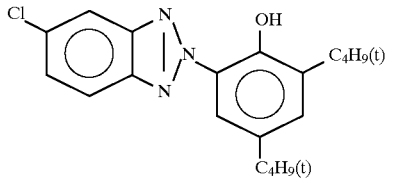

(iv)

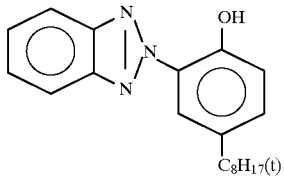

(v)

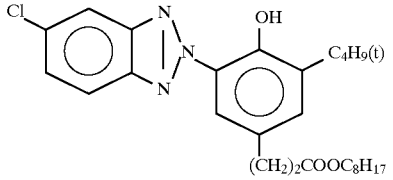

(vi)

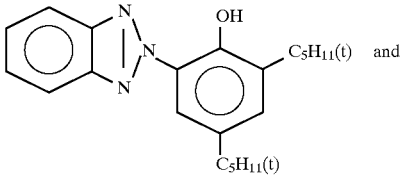

(vii)

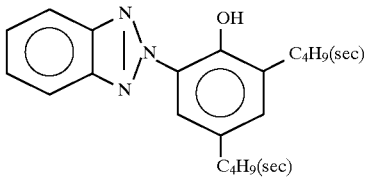

(viii)

The films of the third, fifth and sixth layers of the obtained sample were coated on a transparent base and their refractive indices were measured. Those of Sample No. 101C in Example 1 were 1.52, 1.54 and 1.53, respectively, while those in this example were 1.49, 1.49 and 1.58, respectively. Further, exposure, continuous processing and evaluation were conducted in the same manner as in Example 1. The results obtained are shown in Table 10 below.

TABLE 10

| Sample No. | Δb* (Xenon Light Source) At the Time of Temination of Continuous Processing |
|---|---|
| 401A (Comparison) | +0.41 |
| 401C (Invention) | −1.61 |
| 401H (Invention) | −1.37 |

From the results in Tables 7 and 10, the effect of the present invention is particularly conspicuous in Sample No. 101C containing two or more films each having refractive index of from 1.50 to 1.56.

EXAMPLE 5

Sample was prepared by replacing ultraviolet absorbers in the fifth and sixth layers of Photographic Material No. 101 with UV-5 and changing coating amount to 0.18 g/m$^2$ and 0.33 g/m$^2$, respectively, and constitutional layers were coated on Support No. S31 in Example 2 (Sample No. 501S31).

(UV-5) UV Absorber

1/4/2 mixture by weight ratio of (xiii)/(xiv)/(xv)

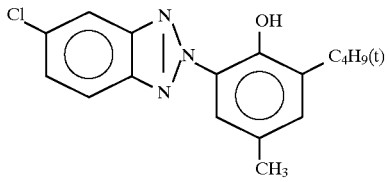

(xiii)

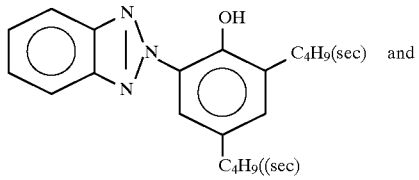

(xiv)

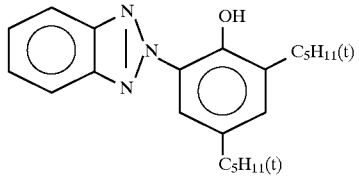

(xv)

The reflection density at 400 nm of the obtained sample was 0.20 (that of Sample No. S31 was 0.27).

Exposure, continuous processing and evaluation were conducted in the same manner as in Example 1. The results on whiteness degree obtained are shown in Table 11 below. The samples processed at the same time were evaluated for light fastness with xenon light of 200,000 lux for 14 days (the cycle of irradiating for 3 hours and not irradiating for 1 hour was repeated). The reduction of the density at the part where yellow density was 2.0 (a monochromatic area) is shown in Table 11 as a criterion of the light fastness.

TABLE 11

| Sample No. | | Δb* (Xenon Light Source) At the Time of Termination of Continuous Processing | Light Fastness |
|---|---|---|---|
| 501S31 | (Invention) | −3.46 | −0.37 |
| S31 | (Invention) | −3.42 | −0.19 |
| 501S30 | (Comparison) | +0.39 | −0.40 |
| S30 | (Comparison) | +0.40 | −0.19 |

It can be seen from the results in Table 11 that, even among the photographic materials according to the present invention, Photographic Material No. S31 which has the reflection density at 400 nm of 0.27 has not only improved whiteness degree but also improved light fastness.

EXAMPLE 6

Photographic material Sample No. S31 prepared in Example 2 was subjected to exposure according to the method in Example 1 and processed in the same manner as in Example 1 except for using the following processing step, color developing solution, bleach-fixing solution and rinsing solution by a paper processor, and evaluation was conducted.

| Step | Processing Temperature (°C.) | Processing Time (sec) | Tank Capacity (liter) | Replenishment Rate* (ml) |
|---|---|---|---|---|
| Color Development | 40 | 15 | 5 | 35 |
| Bleach-Fixing | 40 | 15 | 3 | 35 |
| Rinsing (1) | 40 | 3 | 1 | — |
| Rinsing (2) | 40 | 3 | 1 | — |
| Rinsing (3) | 40 | 3 | 1 | — |
| Rinsing (4) | 40 | 3 | 1 | — |
| Rinsing (5) | 40 | 6 | 1 | 90 |
| Drying | 70–80 | 15 | | |

*Replenishing rate per $m^2$ of the photographic material

Water of rinsing (5) tank was force fed to a reverse osmosis membrane, the penetrated water was charged to rinsing (5) tank, and concentrated water not passed the reverse osmosis membrane was fed back to rinsing (4) tank and used. With respect to the rinsing steps (1) to (4), rinsing was conducted in a 4-tank countercurrent system from rinsing (4) to rinsing (1). For saving the crossover time, blades were installed connecting each rinsing tank and samples were passed therebetween.

The composition of each processing solution was as follows.

| Color Developing Solution | Tank Solution | Replenisher |
|---|---|---|
| Water | 700 ml | 700 ml |
| Sodium Triisopropyl-naphthalene (β) sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 15.8 g | — |
| Potassium Bromide | 0.04 g | — |
| Potassium Carbonate | 27.0 g | 27.0 g |
| Sodium Sulfite | 0.1 g | 0.1 g |

-continued

| Color Developing Solution | Tank Solution | Replenisher |
|---|---|---|
| Disodium-N,N-bis(sulfonato-ethyl) hydroxylamine | 10.0 g | 15.0 g |
| N-Ethyl-N-(13-methanesulfon-amidoethyl)-3-methyl-4-aminoaniline Sulfate | 7.0 g | 21.0 g |
| Brightening Agent (F-18) | 5.0 g | 6.0 g |
| Water to make | 1,000 ml | 1,000 ml |
| pH (25° C.) | 10.35 | 12.6 |

(pH of each processing solution was set to be equal to the pH of the tank solution or replenisher of the color developing solution.)

Bleach-Fixing Solution

The replenisher was prepared by separating component to two solutions.

First Replenisher

| | |
|---|---|
| Water | 150 ml |
| Ethylenebisguanidine Nitrate | 30 g |
| Ammonium Sulfite Monohydrate | 226 g |
| Ethylenediaminetetraacetic Acid | 7.5 g |
| Brightening Agent (F-18) | 1.0 g |
| Ammonium Bromide | 30 g |
| Ammonium Thiosulfate (700 g/liter) | 340 ml |
| Water to make | 1,000 ml |
| pH (25° C.) | 5.82 |

Second Replenisher

| | |
|---|---|
| Water | 140 ml |
| Ethylenediaminetetraacetic Acid | 11.0 g |
| Ammonium Ethylenediamine-tetraacetato Ferrate | 384 g |
| Acetic Acid (50%) | 230 ml |
| Water to make | 1,000 ml |
| pH (25° C.) | 3.35 |

Tank Solution of Bleach-Fixing Solution

| | |
|---|---|
| First Replenisher | 260 ml |
| Second Replenisher | 290 ml |
| Water to make | 1,000 ml |
| pH (25° C.) | 5.0 |

Replenisher of Bleach-Fixing Solution

The following amounts, total 35 l per $m^2$ of the photographic material

| | |
|---|---|
| First Replenisher | 18 ml |
| Second Replenisher | 20 ml |

Rinsing Solution

Ion Exchange Water (each concentration of calcium and magnesium is 3 ppm or less)

It was found that in the constitution of the present invention, even when the developing time, the total processing time and the replenishing rate of replenishers are reduced, printed photographs which are excellent in whiteness degree can be obtained and the present invention is superior in improving effects of changes after continuous processing of samples or when the processed samples are preserved in high temperature and high humidity conditions.

EXAMPLE 7

Photographic samples prepared in Example 1 were processed using the paper processor and processing step in Example 5 except for changing only the exposure to the following step.

Method of Exposure

Three types of laser beams were used as light sources, that is, the wavelength of YAG solid state laser (oscillation wavelength: 946 nm) using a semiconductor laser GaAlAs (oscillation wavelength: 808.5 nm) as an excitation light source converted with SHG crystal of $KNbO_3$ to 473 nm, the wavelength of $YVO_4$ solid state laser (oscillation wavelength: 1,064 nm) using a semiconductor laser GaAlAs (oscillation wavelength: 808.7 nm) as an excitation light source converted with SHG crystal of KTP to 532 nm, and AlGaInP (oscillation wavelength: about 670 nm, manufactured by Toshiba Co., Ltd., Type No. TOLD9211). Laser beam can successively scanning expose a color photographic paper transferring vertically to scanning direction by rotating polyhedron. Using this device, by changing the light amount, the relation between density (D) of a photographic material and light amount (E) (D-log E) was searched and gradation exposure was conducted based on this relationship. Of the light amounts of laser beams of three wavelengths, lights of 473 nm and 532 nm were modulated using an external modulator and exposure amount was controlled. Light amount of laser light of 670 nm was controlled-by changing both the emitting amount of the semiconductor laser and the emitting time. In this time, scanning exposure was conducted at 400 dpi, and an average exposure time per picture element was $5\times10^{-8}$ sec. For restraining the fluctuation of light amount due to changes of temperature, the temperature of semiconductor laser was maintained constant using Peltier element.

The same evaluation in Example 6 was conducted. The constitution of the present invention was excellent in whiteness degree, in particular, fluctuation under high temperature and high humidity preservation was less.

According to the present invention, photographic materials which provide sufficient image density and less fog can be obtained even when the total processing time and the replenishing rate of replenishers are reduced. Even when continuous processing is carried out, and even when color prints obtained through processing according to the present invention are preserved for a long period of time, whiteness degree in a white background is high and stable.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, wherein a silver halide emulsion layer in said at least one light-sensitive silver halide emulsion layer is a high silver chloride emulsion having a silver chloride content of 95 mol % or more, said support comprises a resin coated paper, and a resin layer of the side on which the light-sensitive silver halide emulsion layer is provided of said resin coated paper comprises at least a titanium dioxide pigment comprising grains having a surface, wherein the surface of the grains is coated with a silane coupling agent, and at least one brightening agent selected from the group consisting of a bis-(benzoxazolyl) naphthalene based brightening agent, a bis-(benzoxazolyl) thiophene based brightening agent, a coumarin based brightening agent and a pyrazoline based brightening agent.

2. A silver halide photographic material comprising a support having provided thereon three kinds of light-sensitive silver halide emulsion layers having different light-sensitive wavelength regions, wherein silver halide emulsions in said three kinds of light-sensitive silver halide emulsion layers are high silver chloride emulsions having a silver chloride content of 95 mol % or more and the total coating amount of silver is 0.65 g per $m^2$ or less, said support comprises a resin coated paper, and a resin layer of the side on which the light-sensitive silver halide emulsion layers are provided of said resin coated paper comprises at least a titanium dioxide pigment comprising grains having a surface, wherein the surface of the grains is coated with a silane coupling agent, and at least one bis-(benzoxazolyl) stilbene based brightening agent.

3. The silver halide photographic material as claimed in claim 1, wherein the resin layer of the side on which the light-sensitive silver halide emulsion layer is provided of said resin coated paper comprises two or three water resistant resin layers having different concentrations of the titanium dioxide pigment.

4. The silver halide photographic material as claimed in claim 2, wherein the resin layer of the side on which the light-sensitive silver halide emulsion layer is provided of said resin coated paper comprises two or three water resistant resin layers having different concentrations of the titanium dioxide pigment.

5. The silver halide photographic material as claimed in claim 1, wherein said resin layer comprises at least two layers.

6. The silver halide photographic material as claimed in claim 2, wherein said resin layer comprises at least two layers.

7. The silver halide photographic material as claimed in claim 1, wherein each of the refractive indices of at least two layers of hydrophilic colloid layers constituting said silver halide photographic material is from 1.50 to 1.56.

8. The silver halide photographic material as claimed in claim 2, wherein each of the refractive indices of at least two layers of hydrophilic colloid layers constituting said silver halide photographic material is from 1.50 to 1.56.

9. The silver halide photographic material as claimed in claim 1, wherein the reflection density of said silver halide photographic material at 400 nm is 0.22 or more.

10. The silver halide photographic material as claimed in claim 2, wherein the reflection density of said silver halide photographic material at 400 nm is 0.22 or more.

11. The silver halide photographic material as claimed in claim 1, wherein said silver halide photographic material comprises three kinds of light-sensitive silver halide emulsion layers having different light-sensitive wavelength regions and the total coating amount of silver is 0.65 g per $m^2$ or less.

12. A method for processing a silver halide photographic material comprising a support having provided thereon at least one light-sensitive silver halide emulsion layer, wherein a silver halide emulsion in said at least one light-sensitive silver halide emulsion layer is a high silver chloride emulsion having a silver chloride content of 95 mol % or more, said support comprises a resin coated paper, and a resin layer of the side on which the light-sensitive silver halide emulsion layer is provided of said resin coated paper comprises at least a titanium dioxide pigment comprising grains having a surface, wherein the surface of the grains is coated with a silane coupling agent, and at least one brightening agent selected from the group consisting of a bis (benzoxazolyl)napthalene based brightening agent, a bis (benzoxazolyl)thiophene based brightening agent, a coumarin based brightening agent and a pyrazoline based brightening agent, wherein said material is imagewise exposed to light, and wherein processing is conducted with a replenishing rate of a developing solution of 60 ml or less per $m^2$ of the photographic material.

13. A method for processing a silver halide photographic material comprising a support having provided thereon three kinds of light-sensitive silver halide emulsion layers having different light-sensitive wavelength regions, wherein silver halide emulsions in said three kinds of light-sensitive silver halide emulsion layers are high silver chloride emulsions having a silver chloride content of 95 mol % or more and the total coating amount of silver is 0.65 g per $m^2$ or less, said support comprises at least a titanium dioxide pigment comprising grains having a surface, wherein the surface of the grains is coated with a silane coupling agent, and at least one bis(benzoxazolyl)stilbene based brightening agent, wherein said material is imagewise exposed to light, and wherein processing is conducted with a replenishing rate of a developing solution of 60 ml or less per $M^2$ of the photographic material.

14. The method for processing a silver halide photographic material as claimed in claim 12, wherein the time of development process is 45 seconds or less.

15. The method for processing a silver halide photographic material as claimed in claim 13, wherein the time of development process is 45 seconds or less.

16. The method for processing a silver halide photographic material as claimed in claim 12, wherein the time of development process is 30 seconds or less and time from the start of development until the termination of drying is 120 seconds or less.

17. The method for processing a silver halide photographic material as claimed in claim 13, wherein the time of development process is 30 seconds or less and time from the start of development until the termination of drying is 120 seconds or less.

18. The method for processing a silver halide photographic material as claimed in claim 12, wherein the resin layer of the side on which the light-sensitive silver halide emulsion layer is provided of said resin coated paper comprises two or three water resistant resin layers having different concentrations of the titanium dioxide pigment.

19. The method for processing a silver halide photographic material as claimed in claim 13, wherein the resin layer of the side on which the light-sensitive silver halide emulsion layer is provided of said resin coated paper comprises two or three water resistant resin layers having different concentrations of the titanium dioxide pigment.

* * * * *